US012215505B2

(12) United States Patent
Nilsson et al.

(10) Patent No.: US 12,215,505 B2
(45) **Date of Patent: *Feb. 4, 2025**

(54) RESILIENT FLOOR

(71) Applicant: Välinge Innovation AB, Viken (SE)

(72) Inventors: Mats Nilsson, Ramlösa (SE); Per Nygren, Ramlösa (SE)

(73) Assignee: VÄLINGE INNOVATION AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 18/210,510

(22) Filed: Jun. 15, 2023

(65) Prior Publication Data

US 2024/0159061 A1 May 16, 2024

Related U.S. Application Data

(63) Continuation of application No. 17/694,843, filed on Mar. 15, 2022, now Pat. No. 11,725,395, which is a continuation of application No. 16/713,431, filed on Dec. 13, 2019, now Pat. No. 11,306,486, which is a continuation of application No. 16/027,465, filed on Jul. 5, 2018, now Pat. No. 10,526,793, which is a (Continued)

(51) Int. Cl.

| | |
|---|---|
| ***E04F 15/02*** | (2006.01) |
| ***E04B 5/00*** | (2006.01) |
| ***E04F 15/10*** | (2006.01) |

(52) U.S. Cl.

CPC ..... *E04F 15/02038* (2013.01); *E04B 5/00* (2013.01); *E04F 15/10* (2013.01); *E04F 15/105* (2013.01); *E04F 2201/0138* (2013.01); *E04F 2201/0146* (2013.01); *E04F 2201/0153* (2013.01); *Y10T 29/49623* (2015.01)

(58) Field of Classification Search

CPC ... E04F 15/02038; E04F 15/10; E04F 15/105; E04F 2201/0138; E04F 2201/0146; E04F 2201/0153

See application file for complete search history.

(56) References Cited

U.S. PATENT DOCUMENTS

| | | | |
|---|---|---|---|
| 213,740 | A | 4/1879 | Conner |
| 1,018,987 | A | 2/1912 | Philpot et al. |

(Continued)

FOREIGN PATENT DOCUMENTS

| | | | |
|---|---|---|---|
| CA | 1171079 | A | 7/1984 |
| CA | 1237344 | A | 5/1988 |

(Continued)

OTHER PUBLICATIONS

Memorandum Opinion, *Valinge Innovation AB* v. *Halstead New England Corp. and Home Depot U.S.A., Inc.*, United States District Court for the District of Delaware, C.A. No. 16-1082-LPS-CJB, dated May 7, 2018, 19 pages (Document 162).

(Continued)

*Primary Examiner* — Adriana Figueroa

(74) *Attorney, Agent, or Firm* — Boone IP Law

(57) ABSTRACT

A method of assembling resilient floorboards is disclosed that includes the step of bending an edge of a floorboard during the assembling. The bending reduces the force required for connection of the edge to another edge of a juxtaposed floorboard. The floorboards may be provided with a mechanical locking system for vertical and horizontal locking of two adjacent floorboards.

19 Claims, 9 Drawing Sheets

Related U.S. Application Data continuation of application No. 14/982,608, filed on Dec. 29, 2015, now Pat. No. 10,047,527, which is a continuation of application No. 14/272,895, filed on May 8, 2014, now Pat. No. 9,249,581, which is a continuation of application No. 13/734,406, filed on Jan. 4, 2013, now Pat. No. 8,756,899, which is a continuation of application No. 12/875,293, filed on Sep. 3, 2010, now Pat. No. 8,365,499.

(60) Provisional application No. 61/239,927, filed on Sep. 4, 2009.

(56) References Cited

U.S. PATENT DOCUMENTS 1,361,501 A 12/1920 Schepmoes
1,394,120 A 10/1921 Rockwell
1,723,306 A 8/1929 Sipe
1,743,492 A 1/1930 Sipe
1,787,027 A 12/1930 Wasleff
1,925,070 A 8/1933 Livezey
1,946,646 A 2/1934 Storm
1,946,690 A 2/1934 Haines
2,015,813 A 10/1935 Nielsen
2,088,238 A 7/1937 Ray
2,089,075 A 8/1937 Siebs
2,142,305 A 1/1939 Davis
2,204,675 A 6/1940 Grunert
2,266,464 A 12/1941 Kraft
2,303,745 A 12/1942 Karreman
2,306,295 A 12/1942 Lloyd, V
2,355,834 A 8/1944 Webb
2,497,837 A 2/1950 Nelson
2,740,167 A 4/1956 Rowley
2,769,726 A 11/1956 Wetterau et al.
2,818,895 A 1/1958 Zuber
2,863,185 A 12/1958 Riedi
2,872,712 A 2/1959 Brown et al.
2,947,040 A 8/1960 Schultz
3,055,461 A 9/1962 De Ridder
3,077,703 A 2/1963 Bergstrom
3,087,269 A 4/1963 Hudson
3,120,033 A 2/1964 Andres
3,120,083 A 2/1964 Dahlberg et al.
3,247,638 A 4/1966 Gay, Jr.
3,259,417 A 7/1966 Chapman
3,310,919 A 3/1967 Bue et al.
3,397,496 A 8/1968 Sohns
3,436,888 A 4/1969 Ottosson
3,538,665 A 11/1970 Gohner
3,554,850 A 1/1971 Kuhle
3,578,548 A 5/1971 Wesp
3,619,961 A 11/1971 Sterrett et al.
3,619,963 A 11/1971 Omholt
3,623,288 A 11/1971 Horowitz
3,657,852 A 4/1972 Worthington et al.
3,694,983 A 10/1972 Couquet
3,720,027 A 3/1973 Christensen
3,742,669 A 7/1973 Mansfeld
3,760,547 A 9/1973 Brenneman
3,857,749 A 12/1974 Yoshida
3,883,258 A 5/1975 Hewson
3,919,820 A 11/1975 Green
3,937,861 A 2/1976 Zuckerman et al.
3,946,529 A 3/1976 Chevaux
3,950,915 A 4/1976 Cole
4,023,596 A 5/1977 Tate
4,037,377 A 7/1977 Howell et al.
4,100,710 A 7/1978 Kowallik
4,113,399 A 9/1978 Hansen, Sr.
4,169,688 A 10/1979 Toshio
4,170,859 A 10/1979 Counihan
4,172,169 A 10/1979 Mawson et al.
4,176,210 A 11/1979 Skinner
4,180,615 A 12/1979 Bettoli
4,187,131 A 2/1980 Graham et al.
4,196,554 A 4/1980 Anderson et al.
4,226,064 A 10/1980 Kraayenhof
4,242,390 A 12/1980 Nemeth
4,296,017 A 10/1981 Weissgerber et al.
4,299,070 A 11/1981 Oltmanns et al.
4,312,686 A 1/1982 Smith et al.
4,313,866 A 2/1982 Renshaw
4,315,724 A 2/1982 Taoka et al.
4,333,987 A 6/1982 Kwart et al.
4,393,187 A 7/1983 Boba et al.
4,396,566 A 8/1983 Brinkmann et al.
4,423,178 A 12/1983 Renshaw
4,426,820 A 1/1984 Terbrack et al.
4,454,699 A 6/1984 Strobl
4,489,115 A 12/1984 Layman et al.
4,507,188 A 3/1985 Chu
4,512,131 A 4/1985 Laramore
4,526,418 A 7/1985 Martin
4,570,353 A 2/1986 Evans et al.
4,574,099 A 3/1986 Nixon
4,599,841 A 7/1986 Haid
4,610,900 A 9/1986 Nishibori
4,614,680 A 9/1986 Fry et al.
4,724,187 A 2/1988 Ungar et al.
4,759,164 A 7/1988 Abendroth et al.
4,769,963 A 9/1988 Meyerson
4,772,500 A 9/1988 Stroppiana
4,785,065 A 11/1988 Uhl et al.
4,788,088 A 11/1988 Kohl
4,807,412 A 2/1989 Frederiksen
4,849,768 A 7/1989 Graham
4,944,514 A 7/1990 Suiter
4,947,595 A 8/1990 Douds et al.
4,976,221 A 12/1990 Yetter
5,007,222 A 4/1991 Raymond
5,050,362 A 9/1991 Tal et al.
5,052,158 A 10/1991 D Luzansky
5,076,034 A 12/1991 Bandy
5,112,671 A 5/1992 Diamond et al.
5,134,026 A 7/1992 Melcher
5,148,850 A 9/1992 Urbanick
5,162,141 A 11/1992 Davey et al.
5,182,892 A 2/1993 Chase
5,185,193 A 2/1993 Phenicie et al.
5,229,217 A 7/1993 Holzer
5,274,979 A 1/1994 Tsai
5,295,341 A 3/1994 Kajiwara
5,322,335 A 6/1994 Niemi
5,333,429 A 8/1994 Cretti
5,344,700 A 9/1994 McGath et al.
5,348,778 A 9/1994 Knipp et al.
5,349,796 A 9/1994 Meyerson
5,367,844 A 11/1994 Diedrich
5,380,794 A 1/1995 Schaefer et al.
5,433,806 A 7/1995 Pasquali et al.
5,441,677 A 8/1995 Phillips, Sr.
5,458,953 A 10/1995 Wang et al.
5,465,546 A 11/1995 Buse
5,480,602 A 1/1996 Nagaich
5,502,939 A 4/1996 Zadok et al.
5,503,788 A 4/1996 Lazareck et al.
5,516,472 A 5/1996 Laver
5,548,937 A 8/1996 Shimonohara
5,553,427 A 9/1996 Andres
5,613,339 A 3/1997 Pollock
5,618,602 A 4/1997 Nelson
5,630,304 A 5/1997 Austin
5,642,592 A 7/1997 Andres
5,647,184 A 7/1997 Davis
5,653,099 A 8/1997 MacKenzie
5,660,016 A 8/1997 Erwin et al.
5,662,977 A 9/1997 Spain et al.
5,670,237 A 9/1997 Shultz et al.
5,671,575 A 9/1997 Wu
5,694,730 A 12/1997 Del et al.
5,706,621 A 1/1998 Pervan
5,713,165 A 2/1998 Erwin

(56) References Cited

U.S. PATENT DOCUMENTS

| | | | |
|---|---|---|---|
| 5,724,909 | A | 3/1998 | Pitman et al. |
| 5,728,476 | A | 3/1998 | Harwood et al. |
| 5,755,068 | A | 5/1998 | Ormiston |
| 5,758,466 | A | 6/1998 | Tucker |
| 5,777,014 | A | 7/1998 | Hopper et al. |
| 5,780,147 | A | 7/1998 | Sugahara et al. |
| 5,791,113 | A | 8/1998 | Glowa et al. |
| 5,797,237 | A | 8/1998 | Finkell, Jr. |
| 5,833,386 | A | 11/1998 | Rosan et al. |
| 5,836,128 | A | 11/1998 | Groh et al. |
| 5,856,389 | A | 1/1999 | Kostrzewski et al. |
| 5,858,160 | A | 1/1999 | Piacente et al. |
| 5,863,632 | A | 1/1999 | Bisker |
| 5,869,138 | A | 2/1999 | Nishibori |
| D406,360 | S | 3/1999 | Finkell, Jr. |
| 5,900,099 | A | 5/1999 | Sweet et al. |
| 5,950,389 | A | 9/1999 | Porter |
| 5,989,668 | A | 11/1999 | Nelson et al. |
| 6,004,417 | A | 12/1999 | Roesch et al. |
| 6,006,486 | A | 12/1999 | Moriau et al. |
| 6,023,907 | A | 2/2000 | Pervan |
| 6,027,599 | A | 2/2000 | Wang |
| 6,029,416 | A | 2/2000 | Andersson |
| 6,052,960 | A | 4/2000 | Yonemura |
| 6,065,262 | A | 5/2000 | Motta |
| 6,093,473 | A | 7/2000 | Min |
| 6,101,778 | A | 8/2000 | Maartensson |
| 6,139,945 | A | 10/2000 | Krejchi et al. |
| 6,173,548 | B1 | 1/2001 | Hamar et al. |
| 6,182,410 | B1 | 2/2001 | Pervan |
| 6,189,282 | B1 | 2/2001 | Vanderwerf |
| 6,209,278 | B1 | 4/2001 | Tychsen |
| 6,216,409 | B1 | 4/2001 | Roy et al. |
| 6,233,899 | B1 | 5/2001 | Mellert et al. |
| 6,260,326 | B1 | 7/2001 | Mùller-Hartburg |
| 6,291,078 | B1 | 9/2001 | Chen et al. |
| 6,314,701 | B1 | 11/2001 | Meyerson |
| 6,324,809 | B1 | 12/2001 | Nelson |
| 6,332,733 | B1 | 12/2001 | Hamberger et al. |
| 6,345,481 | B1 | 2/2002 | Nelson |
| 6,363,677 | B1 | 4/2002 | Chen et al. |
| 6,397,547 | B1 | 6/2002 | Maartensson |
| 6,438,919 | B1 | 8/2002 | Knauseder |
| 6,446,405 | B1 | 9/2002 | Pervan |
| 6,455,127 | B1 | 9/2002 | Valtanen |
| 6,460,306 | B1 | 10/2002 | Nelson |
| 6,490,836 | B1 | 12/2002 | Moriau et al. |
| 6,505,452 | B1 | 1/2003 | Hannig et al. |
| 6,536,178 | B1 | 3/2003 | Paalsson et al. |
| 6,546,691 | B2 | 4/2003 | Leopolder |
| 6,553,724 | B1 | 4/2003 | Bigler |
| 6,558,070 | B1 | 5/2003 | Valtanen |
| 6,591,568 | B1 | 7/2003 | Paalsson |
| 6,617,009 | B1 | 9/2003 | Chen et al. |
| 6,647,690 | B1 | 11/2003 | Martensson |
| 6,671,968 | B2 | 1/2004 | Shannon |
| 6,672,030 | B2 | 1/2004 | Schulte |
| 6,675,545 | B2 | 1/2004 | Chen et al. |
| 6,695,944 | B2 | 2/2004 | Courtney |
| 6,711,869 | B2 | 3/2004 | Tychsen |
| 6,715,253 | B2 | 4/2004 | Pervan |
| 6,729,091 | B1 | 5/2004 | Martensson |
| 6,761,008 | B2 | 7/2004 | Chen et al. |
| 6,763,643 | B1 | 7/2004 | Maartensson |
| 6,766,622 | B1 | 7/2004 | Thiers |
| 6,769,218 | B2 | 8/2004 | Pervan |
| 6,769,219 | B2 | 8/2004 | Schwitte et al. |
| 6,772,568 | B2 | 8/2004 | Thiers et al. |
| 6,786,019 | B2 | 9/2004 | Thiers |
| 6,790,512 | B2 | 9/2004 | MacQueen et al. |
| 6,804,926 | B1 | 10/2004 | Eisermann |
| 6,835,421 | B1 | 12/2004 | Dieter |
| 6,851,237 | B2 | 2/2005 | Niese et al. |
| 6,851,241 | B2 | 2/2005 | Pervan |
| 6,854,235 | B2 | 2/2005 | Martensson |
| 6,862,857 | B2 | 3/2005 | Tychsen |
| 6,865,855 | B2 | 3/2005 | Knauseder |
| 6,874,291 | B1 | 4/2005 | Weber |
| 6,874,292 | B2 | 4/2005 | Moriau et al. |
| 6,880,305 | B2 | 4/2005 | Pervan et al. |
| 6,880,307 | B2 | 4/2005 | Schwitte et al. |
| 6,895,881 | B1 | 5/2005 | Whitaker |
| 6,898,911 | B2 | 5/2005 | Kornfalt et al. |
| 6,898,913 | B2 | 5/2005 | Pervan |
| 6,918,220 | B2 | 7/2005 | Pervan |
| 6,922,964 | B2 | 8/2005 | Pervan |
| 6,922,965 | B2 | 8/2005 | Rosenthal et al. |
| 6,928,779 | B2 | 8/2005 | Moriau et al. |
| 6,933,043 | B1 | 8/2005 | Son et al. |
| 6,955,020 | B2 | 10/2005 | Moriau et al. |
| 6,966,963 | B2 | 11/2005 | O'Connor |
| 6,986,934 | B2 | 1/2006 | Chen et al. |
| 7,051,486 | B2 | 5/2006 | Pervan |
| 7,086,205 | B2 | 8/2006 | Pervan |
| 7,090,430 | B1 | 8/2006 | Fletcher et al. |
| D528,671 | S | 9/2006 | Grafenauer |
| 7,121,058 | B2 | 10/2006 | Palsson et al. |
| 7,127,860 | B2 | 10/2006 | Pervan et al. |
| 7,137,229 | B2 | 11/2006 | Pervan |
| 7,152,383 | B1 | 12/2006 | Wilkinson et al. |
| 7,155,871 | B1 | 1/2007 | Stone et al. |
| 7,169,460 | B1 | 1/2007 | Chen et al. |
| 7,171,791 | B2 | 2/2007 | Pervan |
| 7,211,310 | B2 | 5/2007 | Chen et al. |
| 7,251,916 | B2 | 8/2007 | Konzelmann et al. |
| 7,275,350 | B2 | 10/2007 | Pervan et al. |
| 7,328,536 | B2 | 2/2008 | Moriau et al. |
| 7,337,588 | B1 | 3/2008 | Moebus |
| 7,356,971 | B2 | 4/2008 | Pervan |
| 7,377,081 | B2 | 5/2008 | Ruhdorfer |
| 7,386,963 | B2 | 6/2008 | Pervan |
| 7,398,625 | B2 | 7/2008 | Pervan |
| 7,419,717 | B2 | 9/2008 | Chen et al. |
| 7,451,578 | B2 | 11/2008 | Hannig |
| 7,454,875 | B2 | 11/2008 | Pervan et al. |
| 7,484,337 | B2 | 2/2009 | Hecht |
| 7,516,588 | B2 | 4/2009 | Pervan |
| 7,533,500 | B2 | 5/2009 | Morton et al. |
| 7,543,418 | B2 | 6/2009 | Weitzer |
| 7,552,568 | B2 | 6/2009 | Paalsson et al. |
| 7,568,322 | B2 | 8/2009 | Pervan |
| 7,584,583 | B2 | 9/2009 | Bergelin et al. |
| 7,603,826 | B1 | 10/2009 | Moebus |
| 7,607,271 | B2 | 10/2009 | Griffin et al. |
| 7,614,197 | B2 | 11/2009 | Nelson |
| 7,617,645 | B2 | 11/2009 | Moriau et al. |
| 7,617,651 | B2 | 11/2009 | Grafenauer |
| 7,621,094 | B2 | 11/2009 | Moriau et al. |
| 7,634,886 | B2 | 12/2009 | Moriau et al. |
| 7,634,887 | B2 | 12/2009 | Moriau et al. |
| 7,637,066 | B2 | 12/2009 | Moriau et al. |
| 7,640,708 | B2 | 1/2010 | Moriau et al. |
| 7,644,555 | B2 | 1/2010 | Moriau et al. |
| 7,644,557 | B2 | 1/2010 | Moriau et al. |
| 7,647,743 | B2 | 1/2010 | Moriau et al. |
| 7,650,728 | B2 | 1/2010 | Moriau et al. |
| 7,654,054 | B2 | 2/2010 | Moriau et al. |
| 7,658,048 | B2 | 2/2010 | Moriau et al. |
| 7,677,001 | B2 | 3/2010 | Pervan |
| 7,678,215 | B2 | 3/2010 | Martin et al. |
| 7,716,896 | B2 | 5/2010 | Pervan |
| 7,739,849 | B2 | 6/2010 | Pervan |
| 7,763,345 | B2 | 7/2010 | Chen et al. |
| 7,779,597 | B2 | 8/2010 | Thiers et al. |
| 7,802,415 | B2 | 9/2010 | Pervan et al. |
| 7,841,144 | B2 | 11/2010 | Pervan |
| 7,841,150 | B2 | 11/2010 | Pervan |
| 7,856,784 | B2 | 12/2010 | Martensson |
| 7,856,789 | B2 | 12/2010 | Eisermann |
| 7,861,482 | B2 | 1/2011 | Pervan et al. |
| 7,866,110 | B2 | 1/2011 | Pervan |
| 7,866,115 | B2 | 1/2011 | Pervan et al. |
| 7,874,118 | B2 | 1/2011 | Schitter |
| 7,886,497 | B2 | 2/2011 | Pervan |

(56) References Cited

U.S. PATENT DOCUMENTS

| | | | |
|---|---|---|---|
| 7,896,571 | B1 | 3/2011 | Hannig et al. |
| 7,908,816 | B2 | 3/2011 | Grafenauer et al. |
| 7,926,234 | B2 | 4/2011 | Pervan et al. |
| 7,930,862 | B2 | 4/2011 | Bergelin et al. |
| 7,958,689 | B2 | 6/2011 | Lei |
| 7,980,043 | B2 | 7/2011 | Moebus |
| 7,984,600 | B2 | 7/2011 | Alford et al. |
| 8,006,460 | B2 | 8/2011 | Chen et al. |
| 8,021,741 | B2 | 9/2011 | Chen et al. |
| 8,028,486 | B2 | 10/2011 | Pervan et al. |
| 8,033,074 | B2 | 10/2011 | Pervan et al. |
| 8,037,656 | B2 | 10/2011 | Liu et al. |
| 8,038,363 | B2 | 10/2011 | Hannig et al. |
| 8,042,311 | B2 | 10/2011 | Pervan et al. |
| 8,071,193 | B2 | 12/2011 | Ulrich |
| 8,091,238 | B2 | 1/2012 | Hannig |
| 8,099,924 | B2 | 1/2012 | Braun |
| 8,112,891 | B2 | 2/2012 | Pervan |
| 8,132,384 | B2 | 3/2012 | Hannig |
| 8,166,718 | B2 | 5/2012 | Liu |
| 8,191,333 | B2 | 6/2012 | Braun |
| 8,196,366 | B2 | 6/2012 | Thiers et al. |
| 8,215,078 | B2 | 7/2012 | Pervan |
| 8,234,829 | B2 | 8/2012 | Thiers et al. |
| 8,245,478 | B2 | 8/2012 | Bergelin et al. |
| 8,281,549 | B2 | 10/2012 | Du |
| 8,293,058 | B2 | 10/2012 | Pervan et al. |
| 8,302,361 | B2 | 11/2012 | Braun et al. |
| 8,353,140 | B2 | 1/2013 | Pervan et al. |
| 8,356,452 | B2 | 1/2013 | Thiers et al. |
| 8,365,499 | B2 | 2/2013 | Nilsson et al. |
| 8,375,672 | B2 | 2/2013 | Hannig |
| 8,375,674 | B2 | 2/2013 | Braun et al. |
| 8,480,841 | B2 | 7/2013 | Pervan et al. |
| 8,484,924 | B2 | 7/2013 | Braun |
| 8,490,361 | B2 | 7/2013 | Curry et al. |
| 8,499,521 | B2 | 8/2013 | Pervan et al. |
| 8,511,031 | B2 | 8/2013 | Bergelin et al. |
| 8,511,040 | B2 | 8/2013 | Braun et al. |
| 8,544,231 | B2 | 10/2013 | Hannig |
| 8,544,232 | B2 | 10/2013 | Wybo et al. |
| 8,544,234 | B2 | 10/2013 | Pervan et al. |
| 8,584,423 | B2 | 11/2013 | Pervan et al. |
| 8,613,826 | B2 | 12/2013 | Pervan et al. |
| 8,658,274 | B2 | 2/2014 | Chen et al. |
| 8,683,698 | B2 | 4/2014 | Pervan et al. |
| 8,689,512 | B2 | 4/2014 | Pervan |
| 8,707,651 | B2 | 4/2014 | Stockl |
| 8,720,149 | B2 | 5/2014 | Bossuyt |
| 8,726,604 | B2 | 5/2014 | Hannig |
| 8,745,952 | B2 | 6/2014 | Perra et al. |
| 8,756,899 | B2 | 6/2014 | Nilsson et al. |
| 8,763,340 | B2 | 7/2014 | Pervan et al. |
| 8,800,150 | B2 | 8/2014 | Pervan |
| 8,806,832 | B2 | 8/2014 | Kell |
| 8,833,028 | B2 | 9/2014 | Whispell et al. |
| 8,834,992 | B2 | 9/2014 | Chen et al. |
| 8,952,078 | B2 | 2/2015 | Gould |
| 8,966,853 | B2 | 3/2015 | Hannig |
| 8,978,336 | B2 | 3/2015 | Perra et al. |
| 9,103,126 | B2 | 8/2015 | Kell |
| 9,212,492 | B2 | 12/2015 | Pervan et al. |
| 9,217,250 | B2 | 12/2015 | Perra et al. |
| 9,222,267 | B2 | 12/2015 | Bergelin et al. |
| 9,228,360 | B2 | 1/2016 | Schneider |
| 9,249,581 | B2 | 2/2016 | Nilsson et al. |
| 9,260,870 | B2 | 2/2016 | Vermeulen et al. |
| 9,296,191 | B2 | 3/2016 | Pervan et al. |
| 9,314,936 | B2 | 4/2016 | Pervan |
| 9,371,653 | B2 | 6/2016 | Liu |
| 9,410,328 | B2 | 8/2016 | Pervan |
| 9,528,278 | B2 | 12/2016 | Cappelle |
| 9,650,792 | B2 | 5/2017 | Ramachandra |
| 9,695,600 | B2 | 7/2017 | Vandevoorde et al. |
| 9,695,601 | B2 | 7/2017 | Whispell et al. |
| 9,695,851 | B2 | 7/2017 | Hannig |
| 9,714,515 | B2 | 7/2017 | Pervan |
| 9,745,758 | B2 | 8/2017 | Baert et al. |
| 9,765,530 | B2 | 9/2017 | Bergelin et al. |
| 9,777,487 | B2 | 10/2017 | Pervan et al. |
| 9,803,374 | B2 | 10/2017 | Pervan |
| 9,816,270 | B2 | 11/2017 | Pervan et al. |
| 9,856,657 | B2 | 1/2018 | Thiers et al. |
| 9,874,035 | B2 | 1/2018 | Wagner |
| 9,885,186 | B2 | 2/2018 | Liu |
| 9,885,187 | B2 | 2/2018 | Kell |
| 10,000,935 | B2 | 6/2018 | Kell |
| 10,047,527 | B2 | 8/2018 | Nilsson et al. |
| 10,059,084 | B2 | 8/2018 | Lundblad et al. |
| 10,113,318 | B2 | 10/2018 | Cappelle et al. |
| 10,137,659 | B2 | 11/2018 | Pervan |
| 10,214,917 | B2 | 2/2019 | Pervan et al. |
| 10,287,777 | B2 | 5/2019 | Boo |
| 10,301,830 | B2 | 5/2019 | Boo |
| 10,316,526 | B2 | 6/2019 | Kell |
| 10,344,379 | B2 | 7/2019 | Pervan et al. |
| 10,407,919 | B2 | 9/2019 | Boo |
| 10,450,760 | B2 | 10/2019 | Bergelin et al. |
| 10,486,399 | B2 | 11/2019 | Chen et al. |
| 10,493,731 | B2 | 12/2019 | Lundblad et al. |
| 10,526,793 | B2 | 1/2020 | Nilsson et al. |
| 10,704,269 | B2 | 7/2020 | Whispell et al. |
| 10,780,676 | B2 | 9/2020 | Lundblad et al. |
| 10,808,410 | B2 | 10/2020 | Boo et al. |
| 10,837,181 | B2 | 11/2020 | Josefsson et al. |
| 10,844,612 | B2 | 11/2020 | Boo |
| 10,851,549 | B2 | 12/2020 | Boo |
| 10,865,571 | B2 | 12/2020 | Kell |
| 10,975,580 | B2 | 4/2021 | Pervan et al. |
| 10,982,449 | B2 | 4/2021 | Kell |
| 11,066,836 | B2 | 7/2021 | Bergelin et al. |
| 2001/0021431 | A1 | 9/2001 | Chen et al. |
| 2001/0036557 | A1 | 11/2001 | Ingrim et al. |
| 2002/0007606 | A1 | 1/2002 | Kettler et al. |
| 2002/0007608 | A1 | 1/2002 | Pervan |
| 2002/0007609 | A1 | 1/2002 | Pervan |
| 2002/0023702 | A1 | 2/2002 | Kettler |
| 2002/0031646 | A1 | 3/2002 | Chen et al. |
| 2002/0046433 | A1 | 4/2002 | Sellman et al. |
| 2002/0056245 | A1 | 5/2002 | Thiers |
| 2002/0069611 | A1 | 6/2002 | Leopolder |
| 2002/0083673 | A1 | 7/2002 | Kettler et al. |
| 2002/0092263 | A1 | 7/2002 | Schulte |
| 2002/0095894 | A1 | 7/2002 | Pervan |
| 2002/0100231 | A1 | 8/2002 | Miller et al. |
| 2002/0112429 | A1 | 8/2002 | Niese et al. |
| 2002/0112433 | A1 | 8/2002 | Pervan |
| 2002/0142135 | A1 | 10/2002 | Chen et al. |
| 2002/0152707 | A1 | 10/2002 | Martensson |
| 2002/0170257 | A1 | 11/2002 | McLain et al. |
| 2002/0170258 | A1 | 11/2002 | Schwitte et al. |
| 2002/0170259 | A1 | 11/2002 | Ferris |
| 2002/0178674 | A1 | 12/2002 | Pervan |
| 2002/0178681 | A1 | 12/2002 | Zancai et al. |
| 2002/0189183 | A1 | 12/2002 | Ricciardelli |
| 2003/0009971 | A1 | 1/2003 | Palmberg |
| 2003/0024199 | A1 | 2/2003 | Pervan et al. |
| 2003/0024200 | A1 | 2/2003 | Moriau et al. |
| 2003/0033777 | A1 | 2/2003 | Thiers et al. |
| 2003/0037504 | A1 | 2/2003 | Schwitte et al. |
| 2003/0041545 | A1 | 3/2003 | Stanchfield |
| 2003/0084636 | A1 | 5/2003 | Pervan |
| 2003/0101674 | A1 | 6/2003 | Pervan et al. |
| 2003/0101681 | A1 | 6/2003 | Tychsen |
| 2003/0110720 | A1 | 6/2003 | Berard et al. |
| 2003/0140478 | A1 | 7/2003 | Olofsson |
| 2003/0154676 | A1 | 8/2003 | Schwartz |
| 2003/0180091 | A1 | 9/2003 | Stridsman |
| 2003/0188504 | A1 | 10/2003 | Ralf |
| 2003/0196397 | A1 | 10/2003 | Niese et al. |
| 2003/0196405 | A1 | 10/2003 | Pervan |
| 2003/0224147 | A1 | 12/2003 | Maine et al. |
| 2004/0003888 | A1 | 1/2004 | Mott et al. |
| 2004/0031225 | A1 | 2/2004 | Fowler |

(56) References Cited

U.S. PATENT DOCUMENTS

| | | | |
|---|---|---|---|
| 2004/0031227 | A1 | 2/2004 | Knauseder |
| 2004/0035078 | A1 | 2/2004 | Pervan |
| 2004/0049999 | A1 | 3/2004 | Krieger |
| 2004/0060255 | A1 | 4/2004 | Knauseder |
| 2004/0068954 | A1 | 4/2004 | Martensson |
| 2004/0107659 | A1 | 6/2004 | Glockl |
| 2004/0128934 | A1 | 7/2004 | Hecht |
| 2004/0137180 | A1 | 7/2004 | Sjoberg et al. |
| 2004/0139678 | A1 | 7/2004 | Pervan |
| 2004/0168392 | A1 | 9/2004 | Konzelmann et al. |
| 2004/0177584 | A1 | 9/2004 | Pervan |
| 2004/0182036 | A1 | 9/2004 | Sjoberg et al. |
| 2004/0206036 | A1 | 10/2004 | Pervan |
| 2004/0211143 | A1 | 10/2004 | Hanning |
| 2004/0211144 | A1 | 10/2004 | Stanchfield |
| 2004/0219339 | A1 | 11/2004 | Dempsey et al. |
| 2004/0241374 | A1 | 12/2004 | Thiers et al. |
| 2004/0250492 | A1 | 12/2004 | Becker |
| 2004/0255538 | A1 | 12/2004 | Ruhdorfer |
| 2004/0255541 | A1 | 12/2004 | Thiers et al. |
| 2004/0261348 | A1 | 12/2004 | Vulin |
| 2005/0003160 | A1 | 1/2005 | Chen et al. |
| 2005/0021081 | A1 | 1/2005 | Lebner |
| 2005/0028474 | A1 | 2/2005 | Kim |
| 2005/0050827 | A1 | 3/2005 | Schitter |
| 2005/0055943 | A1 | 3/2005 | Pervan |
| 2005/0112320 | A1 | 5/2005 | Wright |
| 2005/0138881 | A1 | 6/2005 | Pervan |
| 2005/0144881 | A1 | 7/2005 | Tate et al. |
| 2005/0160694 | A1 | 7/2005 | Pervan |
| 2005/0166502 | A1 | 8/2005 | Pervan et al. |
| 2005/0166514 | A1 | 8/2005 | Pervan |
| 2005/0166516 | A1 | 8/2005 | Pervan |
| 2005/0176321 | A1 | 8/2005 | Crette et al. |
| 2005/0193677 | A1 | 9/2005 | Vogel |
| 2005/0208255 | A1 | 9/2005 | Pervan |
| 2005/0210810 | A1 | 9/2005 | Pervan |
| 2005/0221073 | A1 | 10/2005 | Liou |
| 2005/0235593 | A1 | 10/2005 | Hecht |
| 2005/0247000 | A1 | 11/2005 | Zhu |
| 2005/0250921 | A1 | 11/2005 | Qiu et al. |
| 2005/0252130 | A1 | 11/2005 | Martensson |
| 2005/0268570 | A2 | 12/2005 | Pervan |
| 2006/0010820 | A1 | 1/2006 | Schwitte et al. |
| 2006/0032168 | A1 | 2/2006 | Thiers et al. |
| 2006/0032175 | A1 | 2/2006 | Chen et al. |
| 2006/0048474 | A1 | 3/2006 | Pervan et al. |
| 2006/0053724 | A1 | 3/2006 | Braun et al. |
| 2006/0064940 | A1 | 3/2006 | Cappelle |
| 2006/0070333 | A1 | 4/2006 | Pervan |
| 2006/0075713 | A1 | 4/2006 | Pervan et al. |
| 2006/0099386 | A1 | 5/2006 | Smith |
| 2006/0101769 | A1 | 5/2006 | Pervan et al. |
| 2006/0130416 | A1 | 6/2006 | Mohr et al. |
| 2006/0144004 | A1 | 7/2006 | Nollet et al. |
| 2006/0154015 | A1 | 7/2006 | Miller et al. |
| 2006/0156666 | A1 | 7/2006 | Caufield |
| 2006/0174974 | A1 | 8/2006 | Brannstrom et al. |
| 2006/0196139 | A1 | 9/2006 | Pervan et al. |
| 2006/0225377 | A1 | 10/2006 | Moriau et al. |
| 2006/0236642 | A1 | 10/2006 | Pervan |
| 2006/0248830 | A1 | 11/2006 | Gustaaf et al. |
| 2006/0248831 | A1 | 11/2006 | Moriau et al. |
| 2006/0260252 | A1 | 11/2006 | Brice |
| 2006/0260254 | A1 | 11/2006 | Pervan |
| 2006/0283127 | A1 | 12/2006 | Pervan |
| 2007/0006543 | A1 | 1/2007 | Engstrom |
| 2007/0011981 | A1 | 1/2007 | Eisermann |
| 2007/0022694 | A1 | 2/2007 | Chen et al. |
| 2007/0028547 | A1 | 2/2007 | Grafenauer et al. |
| 2007/0094986 | A1 | 5/2007 | Moriau et al. |
| 2007/0094987 | A1 | 5/2007 | Moriau et al. |
| 2007/0130872 | A1 | 6/2007 | Goodwin et al. |
| 2007/0151189 | A1 | 7/2007 | Yang |
| 2007/0151191 | A1 | 7/2007 | August |
| 2007/0154840 | A1 | 7/2007 | Thies et al. |
| 2007/0166516 | A1 | 7/2007 | Kim et al. |
| 2007/0175143 | A1 | 8/2007 | Pervan et al. |
| 2007/0175144 | A1 | 8/2007 | Hakansson |
| 2007/0175148 | A1 | 8/2007 | Bergelin et al. |
| 2007/0175156 | A1 | 8/2007 | Pervan et al. |
| 2007/0184230 | A1 | 8/2007 | Verrue et al. |
| 2007/0193178 | A1 | 8/2007 | Groeke et al. |
| 2007/0196624 | A1 | 8/2007 | Chen et al. |
| 2007/0218252 | A1 | 9/2007 | Donald |
| 2007/0275207 | A1 | 11/2007 | Higgins et al. |
| 2008/0000179 | A1 | 1/2008 | Pervan et al. |
| 2008/0000180 | A1 | 1/2008 | Pervan |
| 2008/0000182 | A1 | 1/2008 | Pervan |
| 2008/0000183 | A1 | 1/2008 | Bergelin et al. |
| 2008/0000186 | A1 | 1/2008 | Pervan et al. |
| 2008/0000187 | A1 | 1/2008 | Pervan |
| 2008/0000188 | A1 | 1/2008 | Pervan |
| 2008/0000189 | A1 | 1/2008 | Pervan et al. |
| 2008/0000194 | A1 | 1/2008 | Pervan et al. |
| 2008/0000417 | A1 | 1/2008 | Pervan et al. |
| 2008/0005989 | A1 | 1/2008 | Pervan et al. |
| 2008/0005992 | A1 | 1/2008 | Pervan |
| 2008/0005997 | A1 | 1/2008 | Pervan |
| 2008/0005998 | A1 | 1/2008 | Pervan |
| 2008/0005999 | A1 | 1/2008 | Pervan |
| 2008/0008871 | A1 | 1/2008 | Pervan |
| 2008/0010931 | A1 | 1/2008 | Pervan et al. |
| 2008/0010937 | A1 | 1/2008 | Pervan et al. |
| 2008/0014161 | A1 | 1/2008 | Samain et al. |
| 2008/0028707 | A1 | 2/2008 | Pervan |
| 2008/0028713 | A1 | 2/2008 | Pervan et al. |
| 2008/0029490 | A1 | 2/2008 | Martin et al. |
| 2008/0034701 | A1 | 2/2008 | Pervan |
| 2008/0034708 | A1 | 2/2008 | Pervan |
| 2008/0041007 | A1 | 2/2008 | Pervan et al. |
| 2008/0041008 | A1 | 2/2008 | Pervan |
| 2008/0053028 | A1 | 3/2008 | Moriau et al. |
| 2008/0060308 | A1 | 3/2008 | Pervan |
| 2008/0060309 | A1 | 3/2008 | Moriau et al. |
| 2008/0060310 | A1 | 3/2008 | Moriau et al. |
| 2008/0063844 | A1 | 3/2008 | Chen et al. |
| 2008/0066415 | A1 | 3/2008 | Pervan et al. |
| 2008/0092473 | A1 | 4/2008 | Heyns |
| 2008/0104921 | A1 | 5/2008 | Pervan et al. |
| 2008/0110125 | A1 | 5/2008 | Pervan |
| 2008/0134607 | A1 | 6/2008 | Pervan et al. |
| 2008/0134613 | A1 | 6/2008 | Pervan |
| 2008/0134614 | A1 | 6/2008 | Pervan et al. |
| 2008/0138560 | A1 | 6/2008 | Windmoller |
| 2008/0141610 | A1 | 6/2008 | Thiers et al. |
| 2008/0148674 | A1 | 6/2008 | Thiers et al. |
| 2008/0153609 | A1 | 6/2008 | Kotler |
| 2008/0172971 | A1 | 7/2008 | Pervan |
| 2008/0184646 | A1 | 8/2008 | Alford et al. |
| 2008/0241440 | A1 | 10/2008 | Bauer |
| 2008/0256890 | A1 | 10/2008 | Pervan et al. |
| 2008/0263975 | A1 | 10/2008 | Mead |
| 2008/0311355 | A1 | 12/2008 | Chen et al. |
| 2009/0019808 | A1 | 1/2009 | Palsson et al. |
| 2009/0031662 | A1 | 2/2009 | Chen et al. |
| 2009/0038253 | A1 | 2/2009 | Martensson |
| 2009/0049787 | A1 | 2/2009 | Hannig |
| 2009/0110888 | A1 | 4/2009 | Wuest et al. |
| 2009/0133353 | A1 | 5/2009 | Pervan et al. |
| 2009/0151290 | A1 | 6/2009 | Liu |
| 2009/0155612 | A1 | 6/2009 | Pervan et al. |
| 2009/0159156 | A1 | 6/2009 | Walker |
| 2009/0186710 | A1 | 7/2009 | Joseph |
| 2009/0193748 | A1 | 8/2009 | Boo et al. |
| 2009/0193753 | A1 | 8/2009 | Schitter |
| 2009/0217611 | A1 | 9/2009 | Schrader |
| 2009/0223162 | A1 | 9/2009 | Chen et al. |
| 2009/0226662 | A1 | 9/2009 | Dyczko-Riglin et al. |
| 2009/0235604 | A1 | 9/2009 | Cheng et al. |
| 2009/0249733 | A1 | 10/2009 | Moebus |
| 2009/0260313 | A1 | 10/2009 | Segaert |
| 2009/0272058 | A1 | 11/2009 | Duselis et al. |
| 2009/0320402 | A1 | 12/2009 | Schacht et al. |

(56) References Cited

U.S. PATENT DOCUMENTS

| | | | |
|---|---|---|---|
| 2010/0011695 | A1 | 1/2010 | Cheng et al. |
| 2010/0018147 | A1 | 1/2010 | Du |
| 2010/0018149 | A1 | 1/2010 | Thiers |
| 2010/0031594 | A1 | 2/2010 | Liu et al. |
| 2010/0043333 | A1 | 2/2010 | Hannig |
| 2010/0058702 | A1 | 3/2010 | Lei |
| 2010/0242398 | A1 | 9/2010 | Cullen |
| 2010/0260962 | A1 | 10/2010 | Chen et al. |
| 2010/0293879 | A1 | 11/2010 | Pervan et al. |
| 2010/0300029 | A1 | 12/2010 | Braun et al. |
| 2010/0300030 | A1 | 12/2010 | Pervan et al. |
| 2010/0319293 | A1 | 12/2010 | Dammers |
| 2011/0001420 | A1 | 1/2011 | Tchakarov et al. |
| 2011/0008567 | A1 | 1/2011 | Weeks et al. |
| 2011/0030303 | A1 | 2/2011 | Pervan et al. |
| 2011/0041996 | A1 | 2/2011 | Pervan |
| 2011/0056167 | A1 | 3/2011 | Nilsson |
| 2011/0094178 | A1 | 4/2011 | Braun |
| 2011/0131901 | A1 | 6/2011 | Pervan et al. |
| 2011/0131909 | A1 | 6/2011 | Hannig |
| 2011/0138722 | A1 | 6/2011 | Hannig |
| 2011/0146177 | A1 | 6/2011 | Hannig |
| 2011/0154665 | A1 | 6/2011 | Pervan et al. |
| 2011/0154763 | A1 | 6/2011 | Bergelin et al. |
| 2011/0167744 | A1 | 7/2011 | Whispell et al. |
| 2011/0167751 | A1 | 7/2011 | Engstrom |
| 2011/0173914 | A1 | 7/2011 | Engstrom |
| 2011/0247285 | A1 | 10/2011 | Wybo et al. |
| 2011/0247748 | A1 | 10/2011 | Pervan et al. |
| 2011/0258959 | A1 | 10/2011 | Braun |
| 2011/0296780 | A1 | 12/2011 | Windmoller |
| 2012/0003439 | A1 | 1/2012 | Chen et al. |
| 2012/0017534 | A1 | 1/2012 | Oh |
| 2012/0040149 | A1 | 2/2012 | Chen et al. |
| 2012/0067461 | A1 | 3/2012 | Braun |
| 2012/0124932 | A1 | 5/2012 | Schulte et al. |
| 2012/0137617 | A1 | 6/2012 | Pervan |
| 2012/0180416 | A1 | 7/2012 | Perra et al. |
| 2012/0216472 | A1 | 8/2012 | Martensson et al. |
| 2012/0266555 | A1 | 10/2012 | Cappelle |
| 2012/0276369 | A1 | 11/2012 | Jing et al. |
| 2012/0279154 | A1 | 11/2012 | Bergelin et al. |
| 2013/0014890 | A1 | 1/2013 | Pervan et al. |
| 2013/0042563 | A1 | 2/2013 | Pervan et al. |
| 2013/0042565 | A1 | 2/2013 | Pervan et al. |
| 2013/0047536 | A1 | 2/2013 | Pervan |
| 2013/0111758 | A1 | 5/2013 | Nilsson et al. |
| 2013/0160391 | A1 | 6/2013 | Pervan et al. |
| 2013/0269863 | A1 | 10/2013 | Pervan et al. |
| 2013/0298487 | A1 | 11/2013 | Bergelin et al. |
| 2013/0305649 | A1 | 11/2013 | Thiers |
| 2013/0333182 | A1 | 12/2013 | Pervan et al. |
| 2014/0007539 | A1 | 1/2014 | Pervan et al. |
| 2014/0033633 | A1 | 2/2014 | Kell |
| 2014/0033635 | A1 | 2/2014 | Pervan et al. |
| 2014/0069043 | A1 | 3/2014 | Pervan |
| 2014/0069044 | A1 | 3/2014 | Wallin |
| 2014/0090331 | A1 | 4/2014 | Pervan et al. |
| 2014/0115994 | A1 | 5/2014 | Pervan et al. |
| 2014/0237924 | A1 | 8/2014 | Nilsson et al. |
| 2014/0283466 | A1 | 9/2014 | Boo |
| 2014/0318061 | A1 | 10/2014 | Pervan |
| 2014/0352248 | A1 | 12/2014 | Whispell et al. |
| 2014/0356594 | A1 | 12/2014 | Chen et al. |
| 2014/0366476 | A1 | 12/2014 | Pervan et al. |
| 2014/0366477 | A1 | 12/2014 | Kell |
| 2015/0225964 | A1 | 8/2015 | Chen et al. |
| 2015/0330088 | A1 | 11/2015 | Derelov |
| 2015/0368910 | A1 | 12/2015 | Kell |
| 2016/0016390 | A1 | 1/2016 | Lundblad et al. |
| 2016/0016391 | A1 | 1/2016 | Lundblad et al. |
| 2016/0047129 | A1 | 2/2016 | Bowers |
| 2016/0052245 | A1 | 2/2016 | Chen et al. |
| 2016/0069089 | A1 | 3/2016 | Bergelin et al. |
| 2016/0076260 | A1 | 3/2016 | Pervan et al. |
| 2016/0108624 | A1 | 4/2016 | Nilsson et al. |
| 2016/0186318 | A1 | 6/2016 | Pervan et al. |
| 2016/0194883 | A1 | 7/2016 | Pervan |
| 2016/0194885 | A1 | 7/2016 | Whispell et al. |
| 2016/0201324 | A1 | 7/2016 | Hkansson et al. |
| 2016/0265234 | A1 | 9/2016 | Pervan |
| 2017/0030088 | A1 | 2/2017 | Simoens |
| 2017/0037642 | A1 | 2/2017 | Boo |
| 2017/0037645 | A1 | 2/2017 | Pervan |
| 2017/0175400 | A1 | 6/2017 | Josefsson et al. |
| 2017/0241136 | A1 | 8/2017 | Kell |
| 2017/0350140 | A1 | 12/2017 | Bergelin et al. |
| 2017/0362834 | A1 | 12/2017 | Pervan et al. |
| 2018/0094441 | A1 | 4/2018 | Boo |
| 2018/0313093 | A1 | 11/2018 | Nilsson et al. |
| 2019/0017278 | A1 | 1/2019 | De et al. |
| 2019/0091977 | A1 | 3/2019 | Lundblad et al. |
| 2019/0211569 | A1 | 7/2019 | Boo et al. |
| 2019/0249444 | A1 | 8/2019 | Kell |
| 2019/0277041 | A1 | 9/2019 | Pervan et al. |
| 2019/0394314 | A1 | 12/2019 | Pervan et al. |
| 2020/0056379 | A1 | 2/2020 | Boo |
| 2020/0063441 | A1 | 2/2020 | Boo |
| 2020/0180282 | A1 | 6/2020 | Lundblad et al. |
| 2020/0208409 | A1 | 7/2020 | Kell |
| 2020/0248462 | A1 | 8/2020 | Bergelin et al. |
| 2020/0407981 | A1 | 12/2020 | Boo et al. |
| 2020/0412852 | A9 | 12/2020 | Pervan et al. |
| 2021/0053322 | A1 | 2/2021 | Lundblad et al. |
| 2021/0115680 | A1 | 4/2021 | Whispell et al. |
| 2021/0207385 | A1 | 7/2021 | Boo |
| 2021/0214953 | A1 | 7/2021 | Kell |
| 2021/0230881 | A1 | 7/2021 | Boo |

FOREIGN PATENT DOCUMENTS

| | | | |
|---|---|---|---|
| CA | 2252791 | A1 | 5/1999 |
| CA | 2456513 | A1 | 2/2003 |
| CN | 2076142 | U | 5/1991 |
| CN | 2106197 | U | 6/1992 |
| CN | 2124276 | U | 12/1992 |
| CN | 2272915 | Y | 1/1998 |
| CN | 2301491 | Y | 12/1998 |
| CN | 1270263 | A | 10/2000 |
| CN | 101460688 | A | 6/2009 |
| CN | 101492950 | A | 7/2009 |
| CN | 102482888 | B | 7/2014 |
| DE | 1081653 | B | 5/1960 |
| DE | 1534802 | A1 | 4/1970 |
| DE | 2251762 | A1 | 5/1974 |
| DE | 2824656 | A1 | 1/1979 |
| DE | 0134967 | A1 | 4/1979 |
| DE | 2832817 | A1 | 2/1980 |
| DE | 3150352 | A1 | 10/1982 |
| DE | 3135716 | A1 | 6/1983 |
| DE | 3343601 | A1 | 6/1985 |
| DE | 3538538 | A1 | 5/1987 |
| DE | 3904686 | C1 | 8/1989 |
| DE | 3932980 | A1 | 11/1991 |
| DE | 4020682 | A1 | 1/1992 |
| DE | 4242530 | A1 | 6/1994 |
| DE | 29517995 | U1 | 2/1996 |
| DE | 19854475 | A1 | 7/1999 |
| DE | 29908733 | U1 | 8/1999 |
| DE | 29823681 | U1 | 11/1999 |
| DE | 20002744 | U1 | 8/2000 |
| DE | 20008708 | U1 | 9/2000 |
| DE | 20018817 | U1 | 1/2001 |
| DE | 19944399 | A1 | 4/2001 |
| DE | 10001248 | A1 | 7/2001 |
| DE | 10032204 | C1 | 7/2001 |
| DE | 10006748 | A1 | 8/2001 |
| DE | 20206460 | U1 | 7/2002 |
| DE | 20207844 | U1 | 8/2002 |
| DE | 20214532 | U1 | 2/2004 |
| DE | 10316695 | A1 | 10/2004 |
| DE | 10316886 | A1 | 10/2004 |
| DE | 202004014160 | U1 | 11/2004 |
| DE | 202005004537 | U1 | 6/2005 |

(56) References Cited

FOREIGN PATENT DOCUMENTS

| | | | |
|---|---|---|---|
| DE | 102004001363 | A1 | 8/2005 |
| DE | 102004011531 | B3 | 11/2005 |
| DE | 102005023661 | A1 | 11/2006 |
| DE | 102005024366 | A1 | 11/2006 |
| DE | 102005061099 | A1 | 3/2007 |
| DE | 102006024184 | A1 | 11/2007 |
| DE | 102006058655 | A1 | 6/2008 |
| DE | 202008011589 | U1 | 11/2008 |
| DE | 202008012001 | U1 | 11/2008 |
| DE | 202016102034 | U1 | 5/2016 |
| EP | 0665347 | A1 | 8/1955 |
| EP | 0046526 | A2 | 3/1982 |
| EP | 0562402 | A1 | 9/1993 |
| EP | 0698126 | A1 | 2/1996 |
| EP | 0890373 | A1 | 1/1999 |
| EP | 0903451 | A2 | 3/1999 |
| EP | 1024234 | A2 | 8/2000 |
| EP | 1036341 | A1 | 9/2000 |
| EP | 1045083 | A1 | 10/2000 |
| EP | 1061201 | A2 | 12/2000 |
| EP | 1165906 | A1 | 1/2002 |
| EP | 1262607 | A1 | 12/2002 |
| EP | 1262609 | A1 | 12/2002 |
| EP | 1308577 | A2 | 5/2003 |
| EP | 1350904 | A2 | 10/2003 |
| EP | 1357239 | A2 | 10/2003 |
| EP | 1357904 | A2 | 11/2003 |
| EP | 1362947 | A2 | 11/2003 |
| EP | 1396593 | A2 | 3/2004 |
| EP | 1420125 | A2 | 5/2004 |
| EP | 1437457 | A2 | 7/2004 |
| EP | 1512808 | A1 | 3/2005 |
| EP | 1570143 | A1 | 9/2005 |
| EP | 1585875 | A1 | 10/2005 |
| EP | 1640530 | A2 | 3/2006 |
| EP | 0843763 | B2 | 11/2006 |
| EP | 1938963 | A1 | 7/2008 |
| EP | 2009197 | A1 | 12/2008 |
| EP | 2339092 | A1 | 6/2011 |
| EP | 2189591 | A3 | 3/2012 |
| EP | 2516768 | A2 | 10/2012 |
| ES | 2327502 | T3 | 10/2009 |
| FR | 1293043 | A | 5/1962 |
| FR | 2278876 | A1 | 2/1976 |
| FR | 2445875 | A1 | 8/1980 |
| FR | 2498666 | A1 | 7/1982 |
| FR | 2557905 | A1 | 7/1985 |
| FR | 2810060 | A1 | 12/2001 |
| GB | 190625180 | A | 7/1907 |
| GB | 0484750 | A | 5/1938 |
| GB | 0875327 | A | 8/1961 |
| GB | 0900958 | A | 7/1962 |
| GB | 1189485 | A | 4/1970 |
| GB | 1308011 | A | 2/1973 |
| GB | 1430423 | A | 3/1976 |
| GB | 1520964 | A | 8/1978 |
| GB | 2020998 | A | 11/1979 |
| GB | 2095814 | A | 10/1982 |
| GB | 2117813 | A | 10/1983 |
| GB | 2145371 | A | 3/1985 |
| GB | 2147856 | A | 5/1985 |
| GB | 2243381 | A | 10/1991 |
| GB | 2256023 | A | 11/1992 |
| JP | 56-104936 | U | 8/1981 |
| JP | 56-131752 | A | 10/1981 |
| JP | 57-119056 | A | 7/1982 |
| JP | 57-157636 | U | 10/1982 |
| JP | 59-185346 | U | 12/1984 |
| JP | 60-255843 | A | 12/1985 |
| JP | 62-127225 | A | 6/1987 |
| JP | 01-178659 | A | 7/1989 |
| JP | 01-202403 | A | 8/1989 |
| JP | 01-033702 | Y2 | 10/1989 |
| JP | 03-169967 | A | 7/1991 |
| JP | 05-169534 | A | 7/1993 |
| JP | 05-096282 | U | 12/1993 |
| JP | 05-318674 | A | 12/1993 |
| JP | 06-064108 | A | 3/1994 |
| JP | 06-039840 | B2 | 5/1994 |
| JP | 06-315944 | A | 11/1994 |
| JP | 07-026467 | U | 5/1995 |
| JP | 07-180333 | A | 7/1995 |
| JP | 07-300979 | A | 11/1995 |
| JP | 08-074405 | A | 3/1996 |
| JP | 08-086080 | A | 4/1996 |
| JP | 08-109734 | A | 4/1996 |
| JP | 09-053319 | A | 2/1997 |
| JP | 09-254697 | A | 9/1997 |
| JP | 10-002096 | A | 1/1998 |
| JP | 10-219975 | A | 8/1998 |
| JP | 11-131771 | A | 5/1999 |
| JP | 11-268010 | A | 10/1999 |
| JP | 2002-011708 | A | 1/2002 |
| JP | 3363976 | B2 | 1/2003 |
| KR | 10-1996-0005785 | A | 2/1996 |
| KR | 20-0413217 | Y1 | 4/2006 |
| KR | 10-2007-0000322 | A | 1/2007 |
| KR | 10-2008-0096189 | A | 10/2008 |
| KR | 10-0870496 | B1 | 11/2008 |
| KR | 10-2009-0031347 | A | 3/2009 |
| SE | 506254 | C2 | 11/1997 |
| SE | 0000785 | L | 9/2001 |
| SE | 0103130 | L | 3/2003 |
| WO | 89/03753 | A1 | 5/1989 |
| WO | 90/06232 | A1 | 6/1990 |
| WO | 94/01628 | A2 | 1/1994 |
| WO | 94/26999 | A1 | 11/1994 |
| WO | 94/28183 | A1 | 12/1994 |
| WO | 95/11333 | A1 | 4/1995 |
| WO | 96/07801 | A1 | 3/1996 |
| WO | 96/09262 | A2 | 3/1996 |
| WO | 96/27721 | A1 | 9/1996 |
| WO | 97/10396 | A1 | 3/1997 |
| WO | 97/18949 | A1 | 5/1997 |
| WO | 97/21011 | A2 | 6/1997 |
| WO | 97/47834 | A1 | 12/1997 |
| WO | 98/38401 | A1 | 9/1998 |
| WO | 98/58142 | A1 | 12/1998 |
| WO | 99/17930 | A1 | 4/1999 |
| WO | 99/28767 | A1 | 6/1999 |
| WO | 99/58254 | A1 | 11/1999 |
| WO | 99/66151 | A1 | 12/1999 |
| WO | 99/66152 | A1 | 12/1999 |
| WO | 00/17467 | A1 | 3/2000 |
| WO | 00/20705 | A1 | 4/2000 |
| WO | 00/22225 | A1 | 4/2000 |
| WO | 00/44984 | A1 | 8/2000 |
| WO | 00/47841 | A1 | 8/2000 |
| WO | 00/66856 | A1 | 11/2000 |
| WO | 01/02669 | A1 | 1/2001 |
| WO | 01/02670 | A1 | 1/2001 |
| WO | 01/02671 | A1 | 1/2001 |
| WO | 01/44669 | A2 | 6/2001 |
| WO | 01/47726 | A1 | 7/2001 |
| WO | 01/48331 | A1 | 7/2001 |
| WO | 01/48332 | A1 | 7/2001 |
| WO | 01/48333 | A1 | 7/2001 |
| WO | 01/51732 | A1 | 7/2001 |
| WO | 01/51733 | A1 | 7/2001 |
| WO | 01/53628 | A1 | 7/2001 |
| WO | 01/66877 | A1 | 9/2001 |
| WO | 01/75247 | A1 | 10/2001 |
| WO | 01/77461 | A1 | 10/2001 |
| WO | 01/88306 | A1 | 11/2001 |
| WO | 01/98604 | A1 | 12/2001 |
| WO | 02/41880 | A2 | 5/2002 |
| WO | 02/55809 | A1 | 7/2002 |
| WO | 02/55810 | A1 | 7/2002 |
| WO | 02/60691 | A1 | 8/2002 |
| WO | 02/92342 | A1 | 11/2002 |
| WO | 2002/103135 | A1 | 12/2002 |
| WO | 03/12224 | A1 | 2/2003 |
| WO | 03/16654 | A1 | 2/2003 |
| WO | 03/25307 | A1 | 3/2003 |

(56) References Cited

FOREIGN PATENT DOCUMENTS

| | | | |
|---|---|---|---|
| WO | 03/35396 | A1 | 5/2003 |
| WO | 03/38210 | A1 | 5/2003 |
| WO | 03/44303 | A1 | 5/2003 |
| WO | 03/78761 | A1 | 9/2003 |
| WO | 03/83234 | A1 | 10/2003 |
| WO | 03/85222 | A1 | 10/2003 |
| WO | 03/89736 | A1 | 10/2003 |
| WO | 2004/005648 | A1 | 1/2004 |
| WO | 2004/011740 | A2 | 2/2004 |
| WO | 2004/016876 | A2 | 2/2004 |
| WO | 2004/016877 | A1 | 2/2004 |
| WO | 2004/044348 | A1 | 5/2004 |
| WO | 2004/050780 | A2 | 6/2004 |
| WO | 2004/052357 | A1 | 6/2004 |
| WO | 2004/053256 | A1 | 6/2004 |
| WO | 2004/053257 | A1 | 6/2004 |
| WO | 2004/079130 | A1 | 9/2004 |
| WO | 2004/085765 | A1 | 10/2004 |
| WO | 2005/068747 | A1 | 7/2005 |
| WO | 2005/088029 | A1 | 9/2005 |
| WO | 2005/098163 | A1 | 10/2005 |
| WO | 2006/032378 | A1 | 3/2006 |
| WO | 2006/043893 | A1 | 4/2006 |
| WO | 2006/104436 | A1 | 10/2006 |
| WO | 2006/123988 | A1 | 11/2006 |
| WO | 2006/126930 | A1 | 11/2006 |
| WO | 2006/133690 | A1 | 12/2006 |
| WO | 2007/015669 | A2 | 2/2007 |
| WO | 2007/016978 | A1 | 2/2007 |
| WO | 2007/020088 | A1 | 2/2007 |
| WO | 2007/079845 | A1 | 7/2007 |
| WO | 2007/081267 | A1 | 7/2007 |
| WO | 2007/089186 | A1 | 8/2007 |
| WO | 2007/118351 | A1 | 10/2007 |
| WO | 2007/118352 | A1 | 10/2007 |
| WO | 2008/004960 | A2 | 1/2008 |
| WO | 2008/008016 | A1 | 1/2008 |
| WO | 2008/008824 | A1 | 1/2008 |
| WO | 2008/017281 | A1 | 2/2008 |
| WO | 2008/017301 | A2 | 2/2008 |
| WO | 2008/068245 | A1 | 6/2008 |
| WO | 2008/116623 | A1 | 10/2008 |
| WO | 2008/133377 | A1 | 11/2008 |
| WO | 2008/142538 | A2 | 11/2008 |
| WO | 2009/033623 | A1 | 3/2009 |
| WO | 2009/061279 | A1 | 5/2009 |
| WO | 2009/071822 | A2 | 6/2009 |
| WO | 2009/116926 | A1 | 9/2009 |
| WO | 2010/015516 | A2 | 2/2010 |
| WO | 2010/023042 | A1 | 3/2010 |
| WO | 2010/028901 | A1 | 3/2010 |
| WO | 2010/072357 | A2 | 7/2010 |
| WO | 2010/081532 | A1 | 7/2010 |
| WO | 2010/086084 | A1 | 8/2010 |
| WO | 2010/087752 | A1 | 8/2010 |
| WO | 2010/114236 | A2 | 10/2010 |
| WO | 2010/128043 | A1 | 11/2010 |
| WO | 2011/012104 | A2 | 2/2011 |
| WO | 2011/028171 | A1 | 3/2011 |
| WO | 2011/077311 | A2 | 6/2011 |
| WO | 2012/126046 | A1 | 9/2012 |

OTHER PUBLICATIONS

Mobil oil/Holzwerkstoff-Symposium, Stuttgart 1998, Volker Kettler, Witex AG, pp. 1-24.

Notice of Allowance received for Chinese Patent Application No. 201080036472.2, mailed on Mar. 17, 2014, 3 pages (2 pages of English Translation and 1 pages of Original Document).

Notice of Opposition to a European Patent dated Feb. 29, 2012, filed with the European Patent Office in related European Patent No. 1108529 (EP Patent Application No. 00127179.0) (23 pages).

Notice of Opposition to a European Patent dated Nov. 6, 2013, filed with the European Patent Office in related European Patent No. 2248665 (EP Patent Application No. 10007691.8) (22 pages).

Office Action received for Chinese Patent Application No. 201080036472.2, mailed on Nov. 19, 2013, 9 pages (5 pages of English Translation and 4 pages of Original Document).

Office Action received for Chinese Patent Application No. 201410239256.8, mailed on Dec. 16, 2015, 9 pages (5 pages of English Translation and 4 pages of Original Document).

Office Action received for European Patent Application No. 19168204.6, mailed on May 2, 2022, 5 pages.

Office Action received for Korean Patent Application No. 10-2012-7007078, mailed on Aug. 23, 2016, 7 pages (4 pages of English Translation and 3 pages of Original Document).

Office Action received for Korean Patent Application No. 10-2012-7007078, mailed on Dec. 19, 2016, 8 pages (4 pages of English Translation and 4 pages of Original Document).

Office Action received for Korean Patent Application No. 10-2012-7007078, mailed on Feb. 19, 2016, 16 pages (9 pages of English Translation and 7 pages of Original Document).

Office Action received for Korean Patent Application No. 10-2017-7007637, mailed on Jan. 21, 2019, 16 pages (9 pages of English Translation and 7 pages of Original Document).

Office Action received for Korean Patent Application No. 10-2017-7007637, mailed on Jul. 11, 2017, 4 pages (2 pages of English Translation and 2 pages of Original Document).

Office Action received for Korean Patent Application No. 10-2017-7007637, mailed on Jul. 30, 2019, 6 pages (3 pages of English Translation and 3 pages of Original Document).

Official Communication form European Patent Office for EP 00 127 179.0 dated Mar. 21, 2007, 4 pages.

Order of Partial Summary Judgment—*Valinge Innovation AB* v. *Halstead New England Corp. and Home Depot U.S.A., Inc.,* United States District Court for the District of Delaware, C.A. No. 16-1082-LPS-CJB, dated Sep. 13, 2018, 2 pages (Document 262-1).

Order, *Valinge Innovation Ab* v. *Halstead New England Corp. And Home Depot U.S.A., Inc.,* United States District Court for the District of Delaware, C.A. No. 16/1082-Lps-Cjb, dated May 7, 2018, 2 pp. (Document 163).

Pervan, Darko (Author), Technical Disclosure entitled "VA073a Zip Loc," IP com No. IPCOM000210869D, Sep. 13, 2011, IP.com Prior Art Database, 36 pages.

Pervan, Darko, et al, U.S. Appl. No. 13/615,081, entitled "Floorboard, System and Method for Forming a Flooring, and a Flooring Formed Thereof," filed in the U.S. Patent and Trademark Office on Sep. 13, 2012.

Pervan, Darko, et al. U.S. Appl. No. 14/050,597 entitled "Floor Panel With Sealing Means," filed in the U.S. Patent and Trademark Office on Oct. 10, 2013.

Pervan, Darko, et al. U.S. Appl. No. 14/080,973 entitled "Floorboard System and Method for Forming a Flooring, and a Flooring Formed Thereof," filed in the U.S. Patent and Trademark Office on Nov. 15, 2013.

Pervan, Darko, et al., U.S. Appl. No. 13/596,988, entitled, "Mechanical Locking System for Floor Panels," filed Aug. 28, 2012.

Pervan, Darko, et al., U.S. Appl. No. 14/011,121 entitled "Mechanical Locking System for Floor Panels with Vertical Snap Folding," filed in the U.S. Patent and Trademark Office on Aug. 27, 2013.

Pervan, Darko, et al., U.S. Appl. No. 14/947,436 entitled "Mechanical Locking of Floor Panels with a Vertical Snap Folding," filed in the U.S. Patent and Trademark Office dated Nov. 20, 2015.

Pervan, Darko, et al., U.S. Appl. No. 15/695,437, entitled "Mechanical Locking of Floor Panels with Vertical Snap Folding," filed in the U.S. Patent and Trademark Office dated Sep. 5, 2017.

Pervan, Darko, et al., U.S. Appl. No. 16/253,465 entitled "Mechanical Locking of Floor Panels with Vertical Snap Folding," filed Jan. 22, 2019.

Pervan, Darko, U.S. Appl. No. 13/343,439, entitled "Floorboard and Method for Manufacturing Thereof," filed in the U. S. Patent and Trademark Office on Jan. 4, 2012.

Pervan, Darko, U.S. Appl. No. 14/324,677 entitled "Floorboard and Method for Manufacturing Thereof," filed in the U.S. Patent and Trademark Office on Jul. 7, 2014.

(56) References Cited

OTHER PUBLICATIONS

Pervan, Darko, U.S. Appl. No. 15/164,291, entitled "Mechanical Locking System for Floor Panels," filed in the U.S. Patent and Trademark Office dated May 25, 2016.
Plaintiff'S Opening Claim Construction Brief, *Valinge Innovation AB* v. *Halstead New England Corp. and Home Depot U.S.A., Inc.,* United States District Court for the District of Delaware, C.A. No. 16-1082-LPS-CJB, dated Dec. 11, 2017, 38 pages (Document 86).
Plaintiff's Responsive Claim Construction Brief, *Valinge Innovation AB* v. *Halstead New England Corp. and Home Depot U.S.A., Inc.,* United States District Court for the District of Delaware, C.A. No. 16-1082-LPS-CJB, dated Jan. 16, 2018, 29 pages (Document 98).
Plasticizer, dated Feb. 29, 2012, from Wikipedia (6 pages).
PVC Resin-Solution Viscosity-K Value Chart, Plastemart, (1 page).
Reference: Polymer Properties, Polymer Products from Aldrich, dated 1993, (2 pages).
Second Amended Complaint, *Valinge Innovation AB* v. *Halstead New England Corp., Halstead International; Home Depot U.S.A., Inc.; and The Home Depot, Inc.,* United States District Court for the District of Delaware, Case No. 16-1082-LPS-CJB, dated Mar. 28, 2017, 55 pages.
Soine, H., Holzwerkstoffe, Herstellung und Verarbeitung; Platten, Beschichtungsstoffe, Formteile, TUren, Mabel; Von Hansgert Soine; DRW-Verlag, 1995 (51 pages).
Summons to attend oral proceedings pursuant to Rule 115(1) EPC from European Patent Office dated Nov. 5, 2013 in related European patent No. 1108529 (EP Patent Application No. 00127179.0 (13 pages).
Supplemental Declaration of Robert M. Kimmel, Sc.D. on Claim Construction, with Exhibits A-J, *Valinge Innovation AB* v. *Halstead New England Corp. and Home Depot U.S.A., Inc.,* United States District Court for the District of Delaware, C.A. No. 16-1082-LPS-CJB, dated Jan. 16, 2018, 69 pages (Document 104, 104-1, 104-2).
Third Amended Complaint, *Valinge Innovation AB* v. *Halstead New England Corp. and Home Depot U.S.A., Inc.,* United States District Court for the District of Delaware, C.A. No. 16-1082-LPS-CJB, dated Jul. 10, 2018, 69 pages (Document 214).
U.S. Appl. No. 15/507,602, filed Feb. 28, 2017, Richard William Kell.
Ullmann's Encyclopedia of Industrial Chemistry, "Wood", 1996, vol. A28, 9 pages incl pp. 345-350. VCH Verlagsgesellschaft mbH, VCH Publishers, NY, NY.
Vaiinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.
Whispell, John M., et al., U.S. Appl. No. 15/072,829, entitled "Floor Covering With Interlocking Design," filed in the U.S. Patent and Trademark Office on Mar. 17, 2016.
Whispell, John M., et al., U.S. Appl. No. 16/887,559 entitled "Floor Covering with Interlocking Design," filed May 29, 2020.
Wikes, et al., "Table 5.3 Typical properties of General Purpose Vinyl Plastic Products," PVC Handbook, ISBN 3-446-22714-8, 1988, p. 184.
U.S. Appl. No. 18/302,566, Richard William Kell, Apr. 18, 2023.
U.S. Appl. No. 18/369,836, John M. Whispell, Sep. 18, 2023.
Bergelin, Marcus, et al., U.S. Appl. No. 13/552,357 entitled "Resilient Groove," filed in the U.S. Patent and Trademark Office on Jul. 18, 2012.
Bergelin, Marcus, et al., U.S. Appl. No. 13/943,464, entitled "Resilient Groove," filed in the U.S. Patent and Trademark Office Jul. 16, 2013.
Bergelin, Marcus, et al., U.S. Appl. No. 14/946,080, entitled "Resilient Groove," filed in the U.S. Patent and Trademark Office Nov. 19, 2015.
Boo, Christian, et al., U.S. Appl. No. 16/220,748, entitled "Set of Panels," filed in the U.S. Patent and Trademark Office dated Dec. 14, 2018.
Boo, Christian, et al., U.S. Appl. No. 17/017,085 entitled "Set of Panels," filed in the U.S. Patent and Trademark Office on Sep. 10, 2020.
Boo, Christian, U.S. Appl. No. 14/224,628 entitled "Floorboards Provided with a Mechanical Locking System", filed in the U.S. Patent and Trademark Office on Mar. 25, 2014.
Boo, Christian, U.S. Appl. No. 15/333,630 entitled "Floorboards Provided with a Mechanical Locking System," filed in the U.S. Patent and Trademark Office on Oct. 25, 2016.
Boo, Christian, U.S. Appl. No. 15/404,617 entitled "Set of Panels," filed in the U.S. Patent and Trademark Office filed Jan. 12, 2017.
Boo, Christian, U.S. Appl. No. 16/366, 173 entitled "Set of Panels," filed in the U.S. Patent and Trademark Office on Mar. 27, 2019.
Boo, Christian, U.S. Appl. No. 16/528,992 entitled "Floorboards Provided with a Mechanical Locking System," filed in the U.S. Patent and Trademark Office on Aug. 1, 2019.
Boo, Christian, U.S. Appl. No. 17/067,989 entitled "Floorboards Provided with a Mechanical Locking System," filed in the U.S. Patent and Trademark Office on Oct. 12, 2020.
Boo, Christian, U.S. Appl. No. 17/076,445 entitled "Set of Panels," filed in the U.S. Patent and Trademark Office on Oct. 21, 2020.
Boo, U.S. Appl. No. 17/865,772 entitled "Floorboards Provided With a Mechanical Locking System", filed in the U.S. Patent and Trademark Office Jul. 15, 2022.
Chen, Hao A, et al., U.S. Appl. No. 14/932, 126 entitled "Thermoplastic Planks and Methods for Making the same," filed in the U.S. Patent and Trademark Office on Nov. 4, 2015.
Chen, Hao, et al., U.S. Appl. No. 14/693,232 entitled "Thermoplastic Planks and Methods for Making the Same," filed in the U.S. Patent and Trademark Office Apr. 22, 2015.
Communication Pursuant to Article 94(3) EPC mailed Oct. 13, 2017 in EP Patent Application No. 14 794 996.0, EPO, Munich, DE, 9 pages.
Communication from European Patent Office dated Oct. 29, 2013 with Letter from Opponent dated Oct. 24, 2013 in related European Patent No. 1108529 (EP Patent Application No. 00127179.0) (11 pages).
Complaint, *Valinge Innovation AB* v. *Halstead New England Corp. and The Home Depot, Inc.,* United States District Court for the District of Delaware, Case No. 1-16-cv-01082, dated Nov. 23, 2016, 14 pages.
Composite Panel Report: Laminate Flooring, Wood Diciest, Sep. 1999, p. 37, Cygnus Publishing, Inc., & Affiliates, Fort Atkinson, WI, 6 pages.
Decision to Grant received for European Patent Application No. 10814032.8, mailed on Mar. 28, 2019, 2 pages.
Declaration of Brian A. Biggs in Support of Defendants Halstead New England Corp. and Home Depot U.S.A., Inc.'s Responsive Claim Construction Brief, with Exhibit 1, *Valinge Innovation AB* v. *Halstead New England Corp. and Home Depot U.S.A., Inc.,* United States District Court for the District of Delaware, C.A. No. 16-1082-LPS-CJB, dated Jan. 16. 2018, 6 pages (Document 103, 103-1, 103-2).
Declaration of Pilar G. Kraman in Support of Plaintiff's Opening Claim Construction Brief, with Exhibits 1-6, *Valinge Innovation AB* v. *Halstead New England Corp. and Home Depot U.S.A., Inc.,* United States District Court for the District of Delaware, C.A. No. 16-1082-LPS-CJB, dated Dec. 11, 2017, 65 pages (Document 87, 87-1, 87-2).
Declaration of Pilar G. Kraman in Support of Plaintiff's Responsive Claim Construction Brief, with Exhibits 1-15, *Valinge Innovation AB* v. *Halstead New England Corp. and Home Depot U.S.A., Inc.,* United States District Court for the District of Delaware, C.A. No. 16-1082-LPS-CJB, dated Jan. 16, 2018, 105 pages (Document 99, 99-1).
Declaration of Richard T. Kaczkowski, with Exhibits A-D, *Valinge Innovation AB* v. *Halstead New England Corp. and Home Depot U.S.A., Inc.,* United States District Court for the District of Delaware, C.A. No. 16-1082-LPS-CJB, dated Dec. 11, 2017, 48 pages (Document 91, 91-1).
Declaration of Robert M Kimmel, Sc.D. on Claim Construction, with Exhibits A-Q, *Valinge Innovation AB* v. *Halstead New England Corp. and Home Depot U.S.A., Inc.,* United States District Court for

(56) References Cited

OTHER PUBLICATIONS the District of Delaware, C.A. No. 16-1082-LPS-CJB, dated Dec. 11, 2017, 153 pages (Document 90, 90-1, 90-2).
Declaration of Steven B. MacLean in Support of Plaintiff's Opening Claim Construction Brief, with Exhibits 1-2, *Valinge Innovation AB* v. *Halstead New England Corp. and Home Depot U.S.A., Inc.,* United States District Court for the District of Delaware, C.A. No. 16-1082-LPS-CJB, dated Dec. 11, 2017, 23 pages. (Document 88, 88-1. 88-2).
Declaration of Steven B. MacLean in Support of Plaintiff's Responsive Claim Construction Brief, *Valinge Innovation AB* v. *Halstead New England Corp. and Home Depot U.S.A., Inc.,* United States District Court for the District of Delaware, C.A. No. 16-1082-LPS-CJB, dated Jan. 16, 2018, 25 pages (Document 100).
Defendant Halstead New England Corp.'s Answer to the Third Amended Complaint, Affirmative Defenses and Counterclaim—*Valinge Innovation AB* v. *Halstead New England Corp. and Home Depot U.S.A., Inc.,* United States District Court for the District of Delaware, C.A. No. 16-1082-LPS-CJB, dated Aug. 8, 2018, 172 pages (Document 242, 242-1, 242-2, 242-3—Redacted Version of Document 230).
Defendants Halstead New England Corp. and Home Depot U.S.A., Inc.'s Opening Claim Construction Brief, *Valinge Innovation AB* v. *Halstead New England Corp. and Home Depot U.S.A., Inc.,* United States District Court for the District of Delaware, C.A. No. 16-1082-LPS-CJB, dated Dec. 11, 2017, 36 pages. (Document 89).
Defendants Halstead New England Corp. and Home Depot U.S.A., Inc.'s Responsive Claim Construction Brief, *Valinge Innovation AB* v. *Halstead New England Corp. and Home Depot U.S.A., Inc.,* United States District Court for the District of Delaware, C.A. No. 16-1082-LPS-CJB, dated Jan. 16, 2018, 26 pages (Document 102, 102-1).
Engstrand, "VA-038 Mechanical Locking of Floor Panels With Vertical Folding", Valinge InnovBiion AB, Technical Disclosure, IP com No. IPCOM000179246D, IP.com Prior Art Database, 59 pages.
European Search Report in EP 1 108 529, Apr. 17, 2002 (Mar. 6, 2002), The Hague, NL, 3 pages.
European Search Report received for EP Patent Application No. 10814032.8, mailed on Aug. 2, 2017, 09 pages.
European Search Report received for EP Patent Application No. 19168204.6, mailed on Aug. 1, 2019, 9 pages.
Excerpt from Bodenwanddecke, "USA: Das sind die Trends," Apr. 2000, p. 7.
Exhibits 1-17 (re Document 89), *Valinge Innovation AB* v. *Halstead New England Corp. and Home Depot U.S.A., Inc.,* United States District Court for the District of Delaware, C.A. No. 16-1082-LPS-CJB, dated Dec. 11, 2017, 381 pages (Document 92, 92-1).
Intention to grant received for European Patent Application No. 10814032.8, mailed on Jan. 30, 2019, 6 pages.
International Preliminary Report on Patentability received for PCT Patent Application No. PCT/SE2010/050941, mailed on Mar. 15, 2012, 6 pages.
International Search Report and Written Opinion received for PCT Patent Application No. PCT/SE2010/050941, mailed on Nov. 1, 2010, 9 pages.
Joint Motion for Entry of Partial Summary Judgment—*Valinge Innovation AB* v. *Halstead New England Corp. and Home Depot U.S.A., Inc.,* United States District Court for the District of Delaware, C.A. No. 16-1082-LPS-CJB, dated Sep. 13, 2018, 4 pages (Document 262).
Joseffson, Per, et al., U.S. Appl. No. 15/379,957 entitled "Method for Producing a Mechanical Locking System for Panels," filed in the U.S. Patent and Trademark Office on Dec. 15, 2016.
Kell, Richard William, U.S. Appl. No. 16/392,931, entitled "Vertical Joint System for a Surface Covering Panel," filed in the U.S. Patent and Trademark Office on Apr. 24, 2019.
Kell, Richard William, U.S. Appl. No. 17/094,226 entitled "Vertical Joint System for a Surface Covering Panel," filed in the U.S. Patent and Trademark Office on Nov. 10, 2020.
Laminatfu boden, Technik and Technologien, Laminatforum, 1999, pp. 23-24.
Lowe's, How to Install a Laminate Floor, YouTube video available for viewing at https://voutu.be/zhlXVHAeilk?t=3m52s, Oct. 2008 (last accessed Feb. 15, 2018).
Lundblad, Christer, et al., U.S. Appl. No. 14/790,774 entitled "Method to Produce a Thermoplastic Wear Resistant Foil," filed in the U.S. Patent and Trademark Office Jul. 2, 2015.
Lundblad, Christer, et al., U.S. Appl. No. 14/790,850 entitled "Method to Produce a Thermoplastic Wear Resistant Foil," filed in the U.S. Patent and Trademark Office Jul. 2, 2015.
Intention to grant received for European Patent Application No. 19168204.6, mailed on Jan. 30, 2024, 6 pages.
Intention to grant received for European Patent Application No. 19168204.6, mailed on Sep. 11, 2023, 7 pages.
Notice of Allowance received for Chinese Patent Application No. 201410239256.8, mailed on Jan. 23, 2017, 3 pages (2 pages of English Translation and 1 pages of Original Document).
Notice of Allowance received for Korean Patent Application No. 10-2017-7007637, mailed on Sep. 30, 2019, 4 pages (2 pages of English Translation and 2 pages of Original Document).
Office Action received for Chinese Patent Application No. 201410239256.8, mailed on May 19, 2016, 3 pages of original document only.
U.S. Appl. No. 18/369,822, Christian Boo, Sep. 18, 2023.
U.S. Appl. No. 18/941,341, Lucas Larsson, filed Nov. 8, 2024.

RESILIENT FLOOR

CROSS-REFERENCE TO RELATED APPLICATIONS

This application is a continuation of U.S. application Ser. No. 17/694,843, filed on Mar. 15, 2022, which is a continuation of U.S. application Ser. No. 16/713,431, filed on Dec. 13, 2019, now U.S. Pat. No. 10,526,793, which is a continuation of U.S. application Ser. No. 16/027,465, filed on Jul. 5, 2018, now U.S. Pat. No. 10,526,793, which is a continuation of U.S. application Ser. No. 14/982,608, filed on Dec. 29, 2015, now U.S. Pat. No. 10,047,527, which is a continuation of U.S. application Ser. No. 14/272,895, filed on May 8, 2014, now U.S. Pat. No. 9,249,581, which is a continuation of U.S. application Ser. No. 13/734,406, filed on Jan. 4, 2013, now U.S. Pat. No. 8,756,899, which is a continuation of U.S. application Ser. No. 12/875,293, filed on Sep. 3, 2010, now U.S. Pat. No. 8,365,499, which claims benefit to U.S. Provisional Application No. 61/239,927, filed Sep. 4, 2009. The entire contents of each of U.S. application Ser. No. 17/694,843, U.S. application Ser. No. 16/713,431, U.S. application Ser. No. 16/027,465, U.S. application Ser. No. 14/982,608, U.S. application Ser. No. 14/272,895, U.S. application Ser. No. 13/734,406, U.S. application Ser. No. 12/875,293 and U.S. Provisional Application No. 61/239,927 are each hereby incorporated by reference in its entirety.

TECHNICAL FIELD

The present invention generally concerns a method of assembling of floorboards provided with a mechanical locking system.

BACKGROUND OF THE INVENTION

Floorboards with a wood-based core that are provided with a mechanical locking system and methods of assembling such floorboards by angling-angling, angling-snapping or vertical folding are disclosed in e.g. WO 94/26999, WO 01/77461, WO 2006/043893 and WO 01/75247. Floorboards of resilient material, e.g. PVC, are known, commonly referred to as LVT (Luxury Vinyl Tiles) that are glued down to the subfloor or bonded at the edges to each other WO 2008/008824.

SUMMARY OF THE INVENTION

A method is disclosed for assembling floorboards, which are so called resilient floorboards i.e. the core is of a resilient material for example vinyl or PVC. The known methods of assembling floorboards that are mentioned above are difficult to use when assembling resilient floorboards since resilient floorboards easily bend which make it hard to use the angling-angling method and it is unfeasible to use the angling-snapping method since it requires a force to be applied, at an opposite edge in relation to the edge of the floorboard which is intended to be connected, by e.g. a hammer and a tapping block and the resilient core of the resilient floorboard absorbs the applied force. The known vertical folding methods are also difficult to apply due to the increased friction in the resilient material. The disclosed method makes the assembling easier and reduces the force needed for connection of the floorboards.

Furthermore, a locking system suitable for the method is disclosed. The locking system decreases the friction forces that must be overcome when installing the resilient floorboards.

An aspect of the invention is a method of assembling resilient floorboards, which are provided with a mechanical locking system, which method comprises the step of:

positioning a floorboard edge, provided with a first device of said mechanical locking system (11), juxtaposed another floorboard edge, provided with a second device of said mechanical locking system (11);

bending (30) the floorboard (2) along the edge; and applying a force (F) on a first part of the floorboard edge, wherein at said first part of the floorboard edge said first device is pushed into said second device to obtain a vertical and horizontal mechanical locking of a part of the floorboards' edges.

The bending makes it possible to finalize the connection of only a part of the edge of the floorboard, instead of the whole edge as in the known methods, and consequently the force needed to assemble the floorboards is considerably reduced.

The bending is preferably achieved by raising an outer part of said edge preferably by positioning of a raising device, e.g. a wedge, or a hand/finger of the assembler under said floorboard. The raised position of the outer part of said edge is preferably maintained during the force-applying step. In a preferred embodiment also the position of the raising device is maintained during the force-applying step.

The method comprises thereafter preferably the step of applying a force to a new part of the edge, which new part is adjacent to the mechanically locked part, and repeating this step until the whole edge is connected to said another edge.

The force is preferably applied by a tool and most preferably by a tool with a rotatable part.

In a preferred embodiment, the first device is an upper locking strip, which is resiliently bendable, with a downwardly protruding locking element and the second device is a lower locking strip provided with an upwardly protruding locking element. The resiliently bendable locking strip facilitates the connection of the floorboards. The downwardly protruding locking element is provided with a locking surface, which cooperates, for horizontal locking, with a locking surface of the upwardly protruding locking element. The locking strips are integrally formed with the resilient floorboards and preferably of the same resilient material. The downwardly and/or the upwardly protruding locking element is preferably provided with a guiding surface which are configured to guide the locking elements in to a position where the floorboards are connected by the locking elements and the locking surfaces cooperate.

The resilient floorboards are in a preferred embodiment made of a bendable thermoplastic, e.g. vinyl, surlyn, and PVC. Floorboards of vinyl are generally referred to as LVT (Luxury Vinyl Tiles). In a most preferred embodiment the thickness of the floorboard is about 4 mm to about 10 mm. If the floorboards are too thin it is hard to produce a locking system integrally in the floorboard material and if they are too thick it is hard to assemble the floorboards with the disclosed method.

The floorboards are in a preferred embodiment provided with an upper decorative layer made of a similar resilient material and most preferably provided with a balancing layer and/or a sublayer.

The force is preferably applied with a tool, which comprises a handle and a press part for applying a force on the floorboard. Preferably, the press part is provided with an outer round or circular shape for applying the force on the floorboard and in the most preferred embodiment the press part is rotatable.

DETAILED DESCRIPTION OF EMBODIMENTS

Figure 1A:
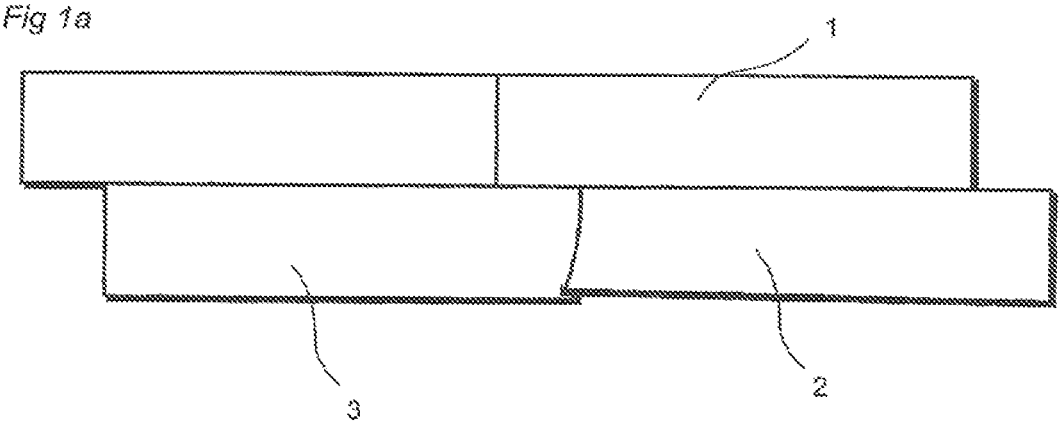
FIGS. 1*a*-1*b* show an embodiment of the assembling method.
Figure 1B:
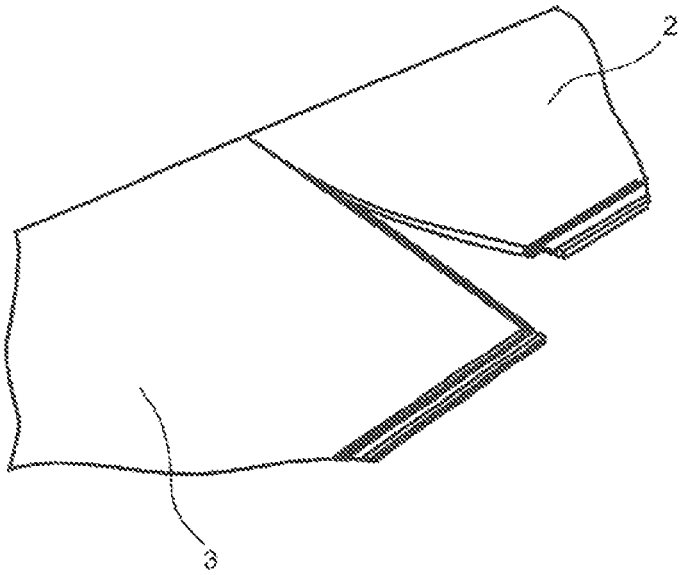

An embodiment of a method of assembling resilient floorboards (1, 2, 3) with a mechanical locking system 11 is shown in FIGS. 1*a* and 1*b*. An edge of a floorboard 2 is positioned juxtaposed another edge of another floorboard 3. The edge of the floorboard is bent (30) along the edge during the assembling and the connection of the floorboard edges to each other. In this embodiment the edge and said another edge are short edges and a long edge of the floorboard is connected to a long edge of a floorboard 1 in another row, by a mechanical angling locking system, simultaneous with the short edge connection, by an angular motion.

Figure 5A:
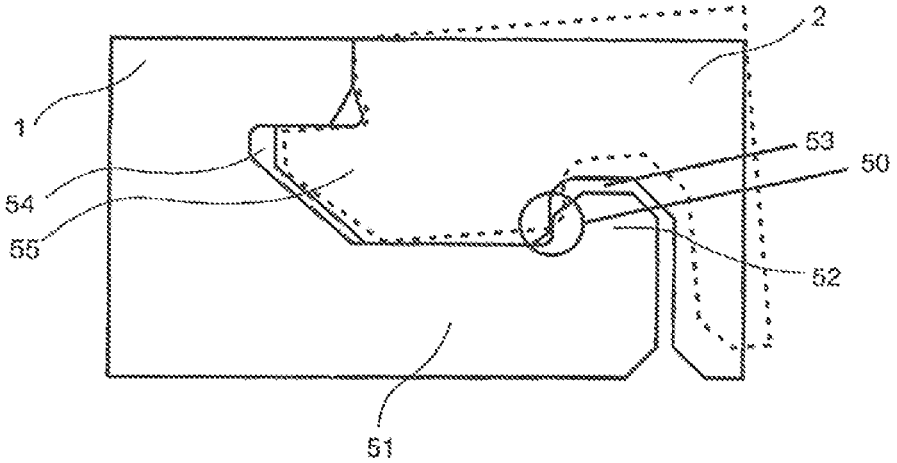
FIGS. 5*a*-5*b* show an embodiment of a locking system configured for connection by angling.
Figure 5B:
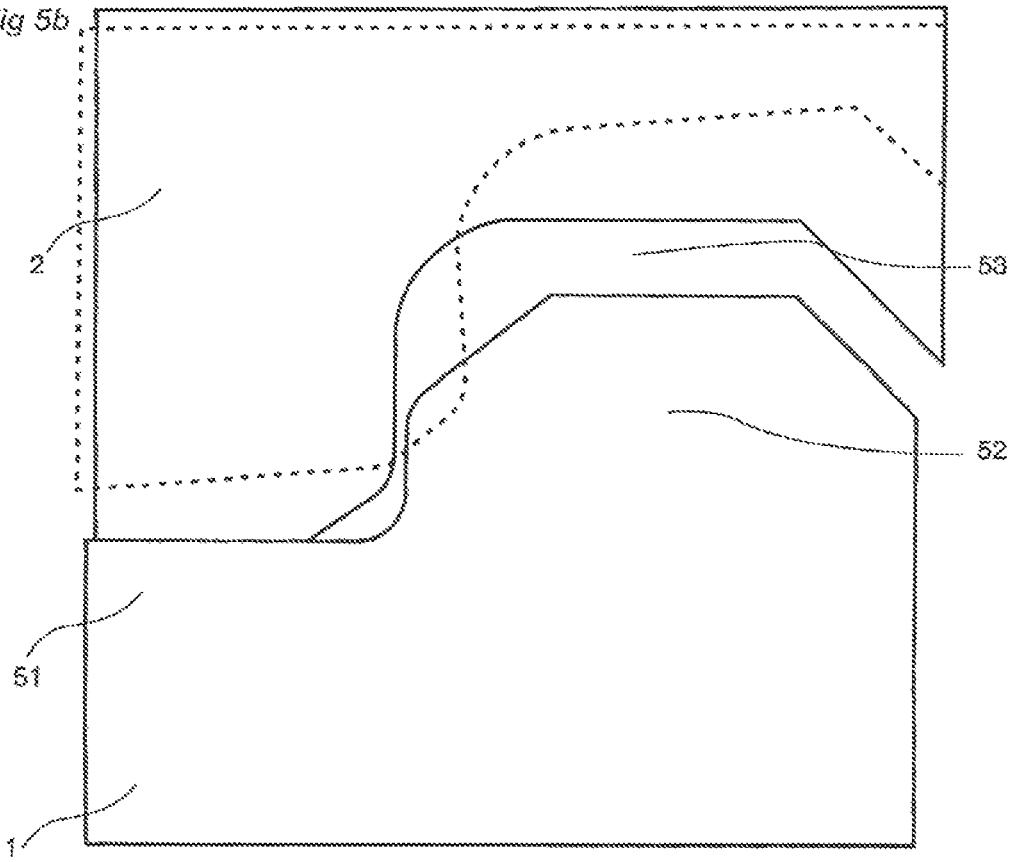

An embodiment of a mechanical angling locking system is shown in FIGS. 5*a* and 5*b*. Embodiments of the mechanical locking system 11 at the short edges is shown in FIGS. 6*a* to 9*a*. When assembling a complete floor the method shown in FIG. 1*a* is naturally applied and repeated for each resilient floorboard, which is provided with the locking system at each short edge and the mechanical angling locking system at each long side, until all resilient floorboards are connected.

The resilient floorboards may also be of square shape with the mechanical locking system 11 provided at two opposite edges of each floorboard and the mechanical angling locking system provided at two other opposite edges of each floorboard. It is also possible to provide floorboards of rectangular shape with the mechanical locking system 11 at the long edges and the mechanical angling locking system at the short edges.

Figure 2A:
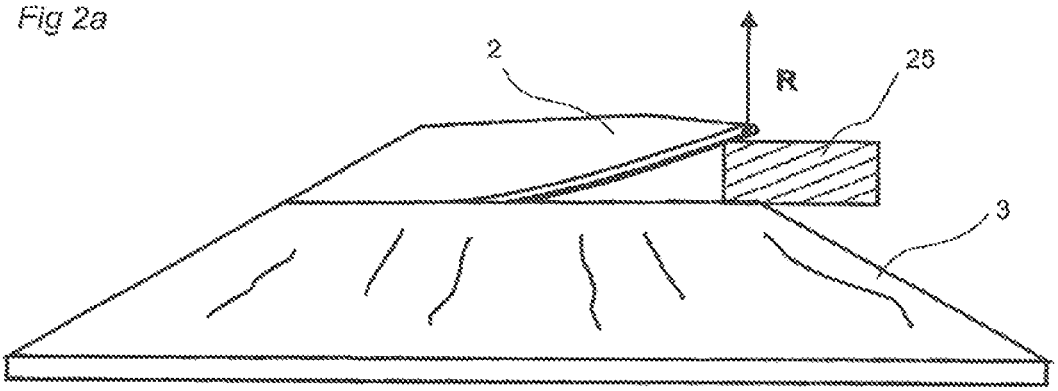
FIGS. 2*a*-2*b* show an embodiment of the assembling method.
Figure 2B:
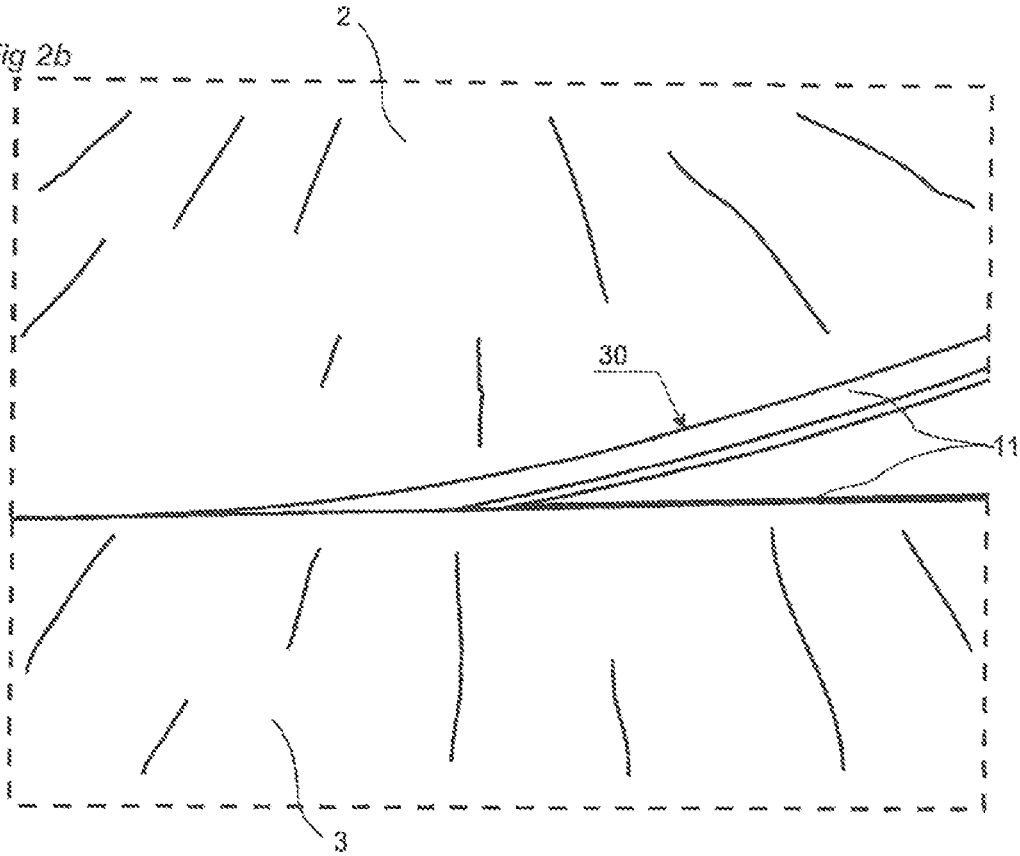
Figure 3A:
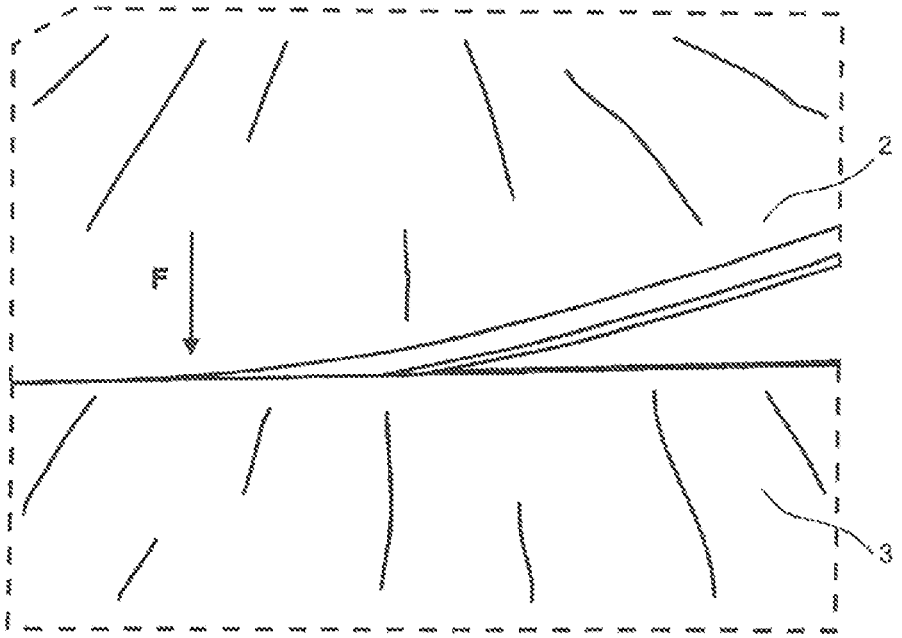
FIGS. 3*a*-3*b* show embodiments of the assembling method.

FIG. 2*a* shows the assembling from another view and FIG. 2*b* shows a detailed view of the bent (30) floorboard 2 edge and that a part of the edge is pressed down such that parts of the floorboards 2, 3 are locked to each other by the mechanical locking system 11. The edge is pressed down by applying a vertical force F at the edge on the floorboard, as disclosed in FIG. 3*a*, on a part of the edge which is closest to said another edge, wherein the part of the edge is mechanically locked to another part of said another edge by the mechanically locking system 11. This is repeated until the whole edge is connected vertically and horizontally to said another edge.

The bending of the floorboard makes it possible to finalize the locking of only a part of the edge of the floorboard, instead of the whole edge as in the known methods, and as a result the force required to connect the floorboards is considerably reduced. Since only a part of the edge of the floorboard is locked the area in the mechanical locking system that is in contact during the connection is reduced and consequently the friction created in the mechanical locking is reduced and thereby the force required. The bending is preferably achieved by raising (R) an outer part of said edge by positioning of a raising device (25), e.g. a wedge, or a hand/finger of the assembler under said floorboard. The position of the raising device is maintained during the force-applying step.

Figure 3B:
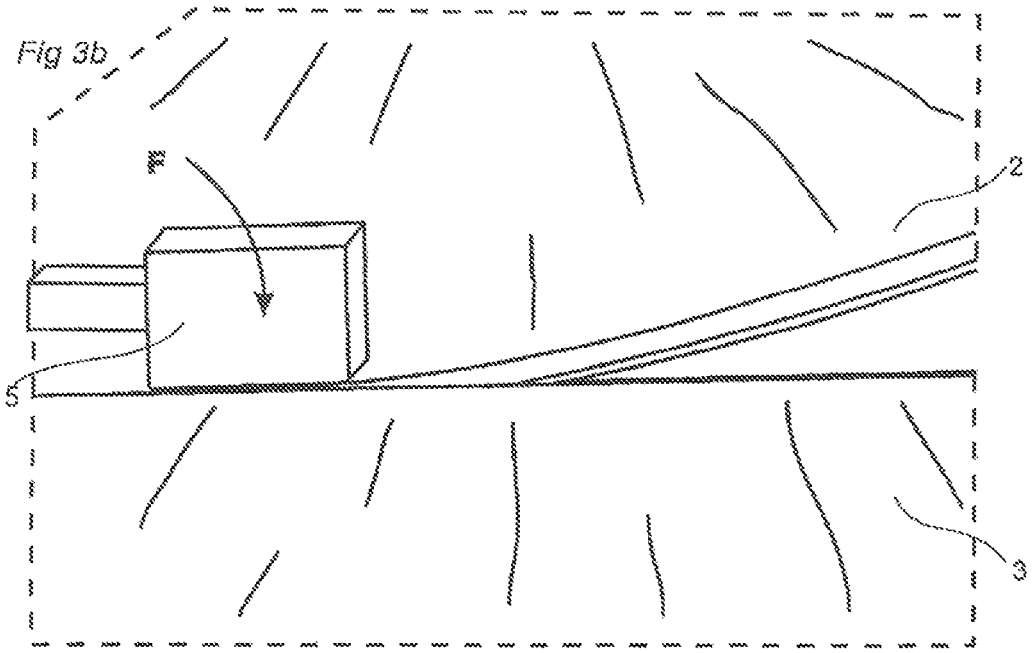
Figure 4A:
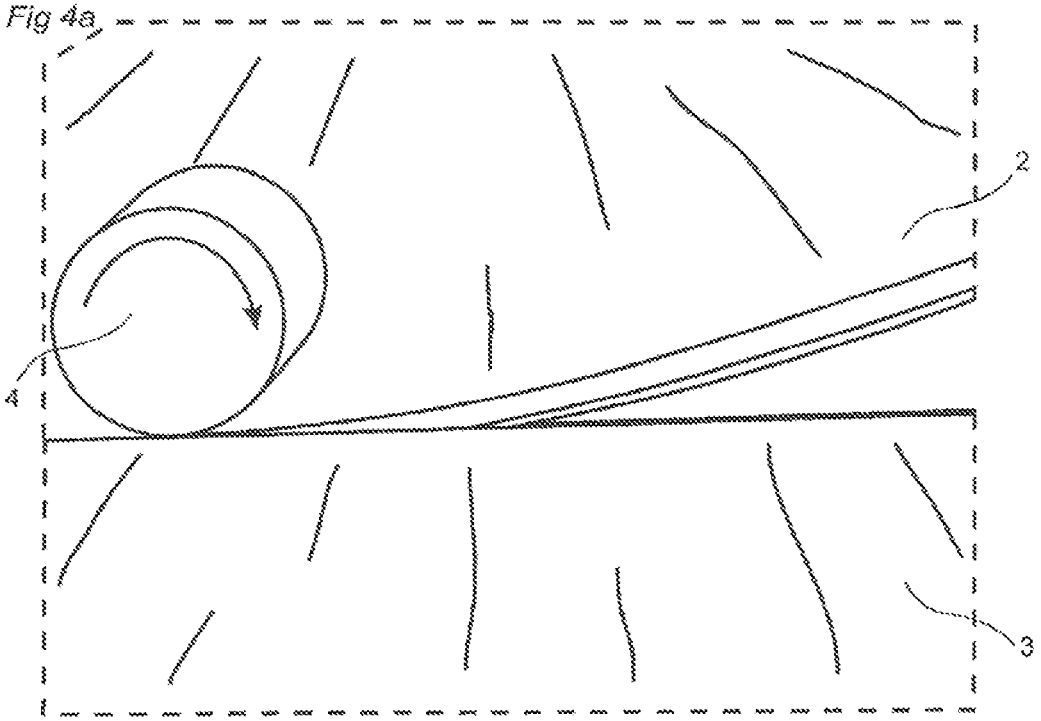
FIGS. 4*a*-4*b* show embodiments of the assembling method.
Figure 4B:
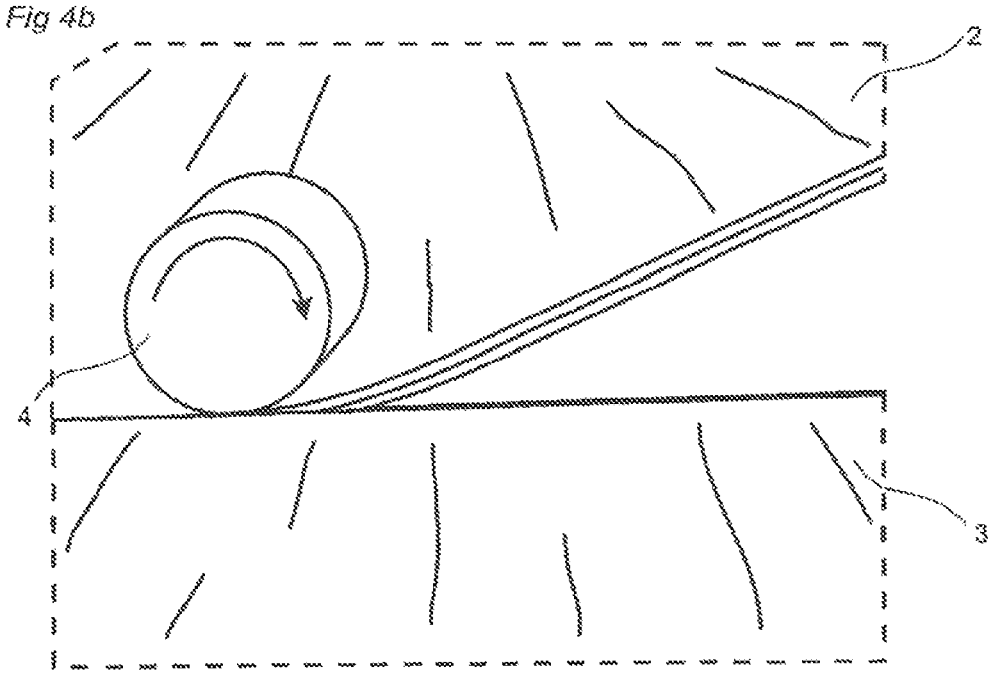

The force may be applied directly, without tools, on the floorboard e.g. by a hand or a foot of the assembler. However, a tool 4, 5 may be used to apply the force as disclosed in FIGS. 3*b*, 4*a* and 4*b*. In FIG. 4*b* only a part of the floorboard is bent while the rest of the floorboard edge continues straight in the direction of the tangent of the bent part. Most preferably a tool with a rotatable press part is used to apply the force. FIG. 9*b* shows an embodiment of such a tool.

The floorboard-assembling tool in FIG. 9*b* comprises a handle 93 and press part 94, which is of a circular shape. The rotatable press part 94 makes it easy to move the tool, by one hand of the assembler, along the edge of the floorboard, which is going to be connected, and bend the floorboard with the other hand.

The mechanical angling locking system in FIG. 5*a*-*b* comprises a locking strip 51, a locking element 52 and a tongue groove 54 at an edge of a resilient floorboard 1 and a locking groove 53 and a tongue 55 at an edge of an adjacent resilient floorboard 2. The tongue 55 cooperates with the tongue groove 54 for vertical locking and the locking element 52 cooperates with the locking groove 53 for horizontal locking, similar to the angling locking systems disclosed in WO 01/77461.

Compared to the locking system, which is produced in a wood-based core, disclosed in WO 01/77461 it is possible to produce a mechanical angling locking system in a resilient floorboard with a shorter locking strip and/or higher locking angle and/or increased locking surface area, as disclosed in FIG. 5*b*, which is an enlarged view of area 50 in FIG. 5*a*. This is due to the resilient material, which makes it possible to bend the locking strip more without breaking it. The angling locking system is preferably integrally formed in one piece with the resilient material of the floorboard.

Figure 6A:
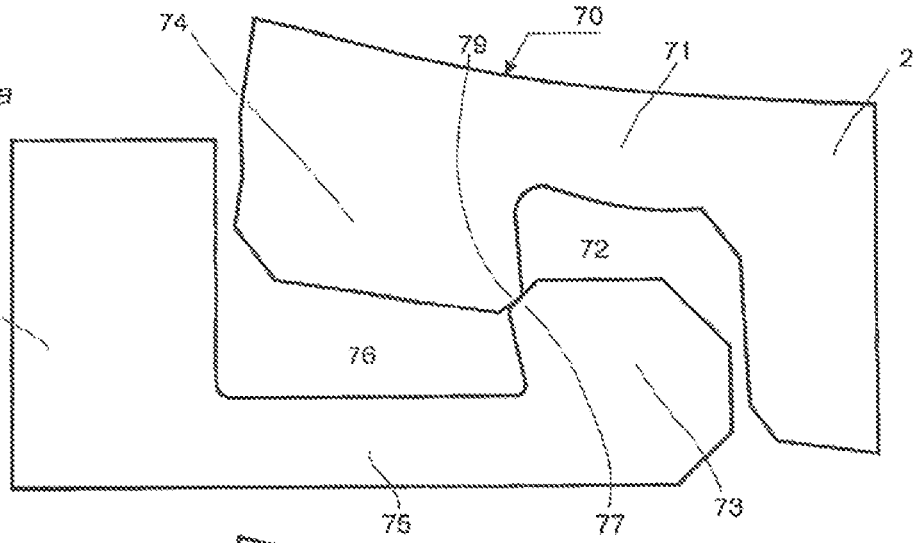
FIGS. 6*a*-6*c* show an embodiment of resilient floorboards during assembling.
Figure 6B:
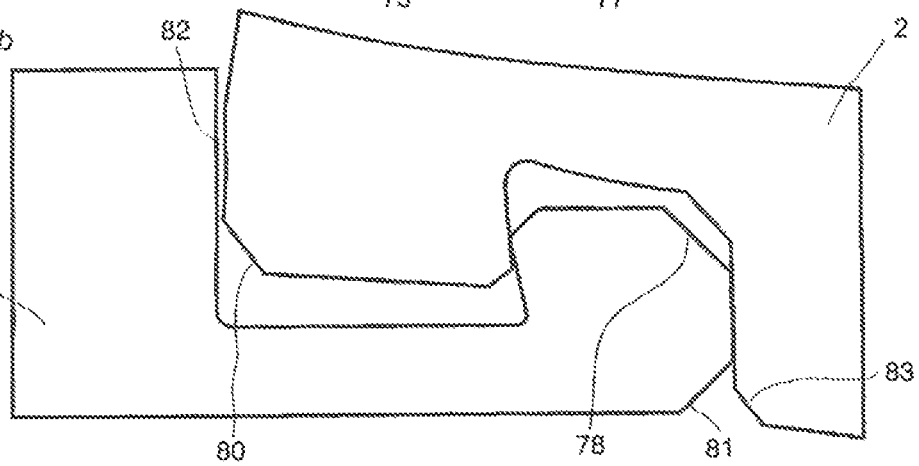
Figure 6C:
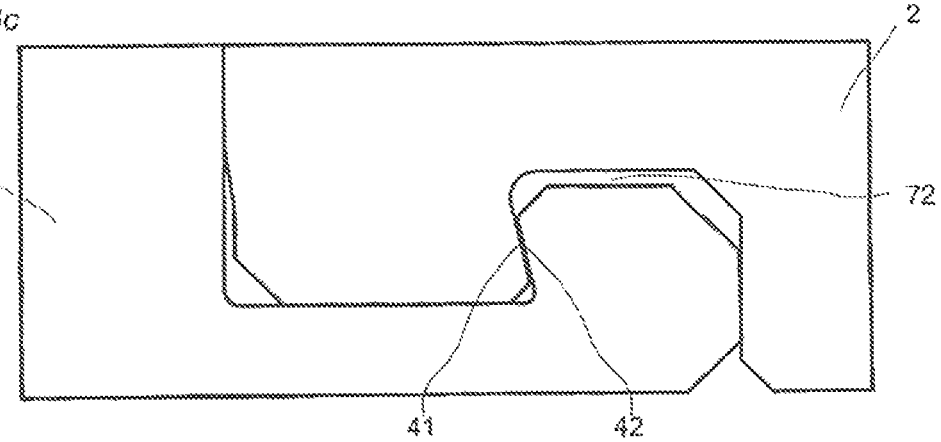

An embodiment of the mechanical locking system is disclosed in FIGS. 6*a*-6*c* in which figures a cross-section of the locking system is shown in three sequential steps during the connection. A first device of the mechanical locking system comprises an upper, and upwardly resiliently bendable, locking strip 71 at an edge of a floorboard 2 and a second device of the mechanical locking system comprises a lower locking strip 75 at an edge of another floorboard 3. The upper and the lower locking strip is provided with a downwardly and an upwardly protruding locking element 74, 73 respectively. The locking elements are provided with locking surfaces 41, 42 configured to cooperate for horizontal locking of the floorboards.

An upwardly bending of the upper locking strip 71 across the edge (see FIG. 6*a*-6*b*), facilitates a positioning of the downwardly protruding locking element 74 between the upwardly protruding locking element and an upper edge of the floorboard 3 in a position where the locking surface cooperates, as shown in FIG. 6 *c*.

The downwardly protruding locking element is preferably provided with a guiding surface 79, which is configured to cooperate (see FIG. 6*a*) with the upwardly protruding locking element 73 in order to facilitate the positioning.

Preferably, the upwardly protruding locking element 73 is provided with another guiding surface 77, which is configured to cooperate (see FIG. 6*a*) with the guiding surface 79 to further facilitate the positioning.

It is also possible to only provide the upwardly protruding locking element 73 with a guiding surface, which is configured to cooperate with an edge of the downwardly protruding locking element.

The angle 44 of the guiding surface 79 and the angle of 43 said another guiding surface 77 are preferably more than about 30° and most preferably more than about 45°.

In a preferred embodiment the mechanical locking system is provided with one or more additional guiding surfaces, which guide the floorboards to the correct location for connection:

- a guiding surface 80 at the downwardly protruding locking element, which guiding surface cooperates with an upper edge of the said other floorboard; and
- a guiding surface 83 at the lower edge of the floorboard, which guiding surface cooperates with an edge or a guiding surface of the upwardly protruding locking element.

A space 81, shown in FIG. 6*b*, under the upwardly protruding locking element facilitates bending of the lower locking strip during the connection of the lower locking strip. A space 72 above the upwardly protruding locking element ensures a proper connection of the floorboards, without risking that the floorboard is prevented reaching the position where the upper surfaces of the floorboards are in the same plane.

Figure 7A:
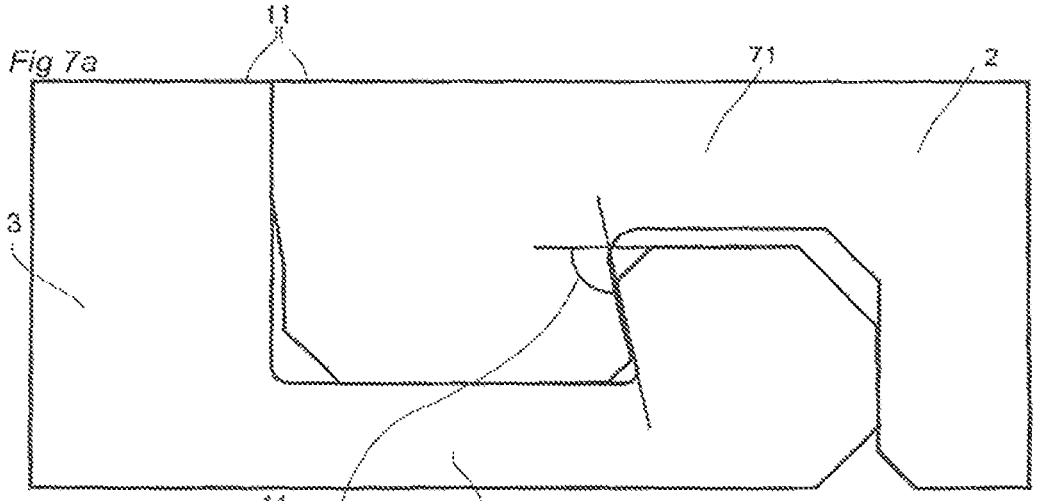
FIGS. 7*a*-7*c* show embodiments of a locking system for resilient floorboards.
Figure 7B:
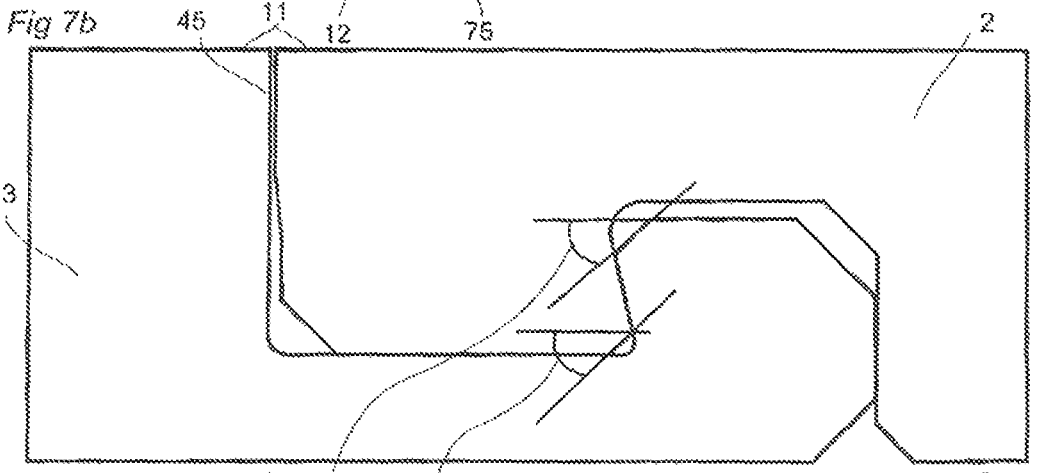
Figure 7C:
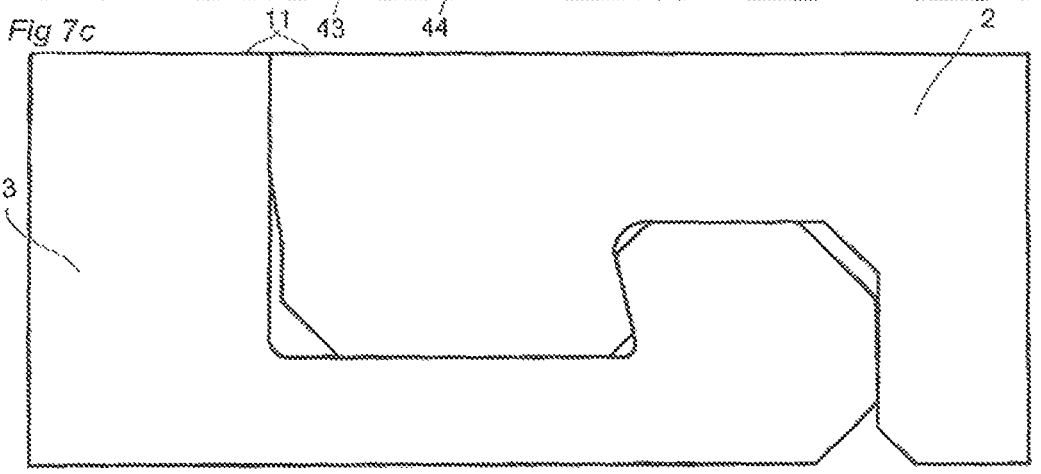
Figure 8A:
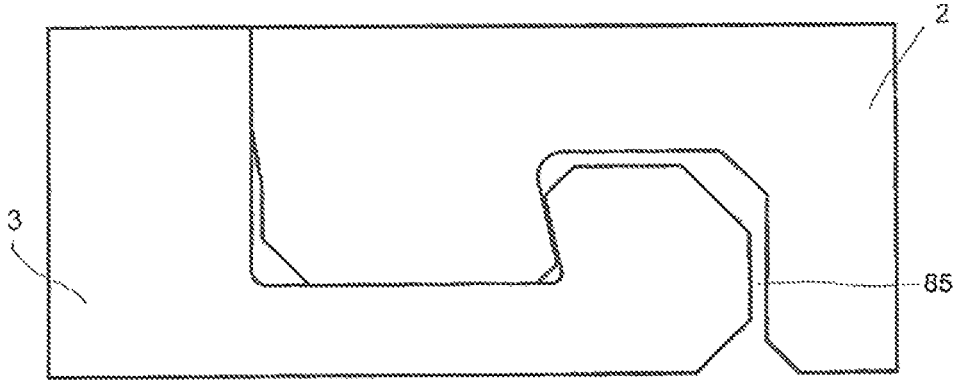
FIGS. 8*a*-8*c* show embodiments of a locking system for resilient floorboards.
Figure 8B:
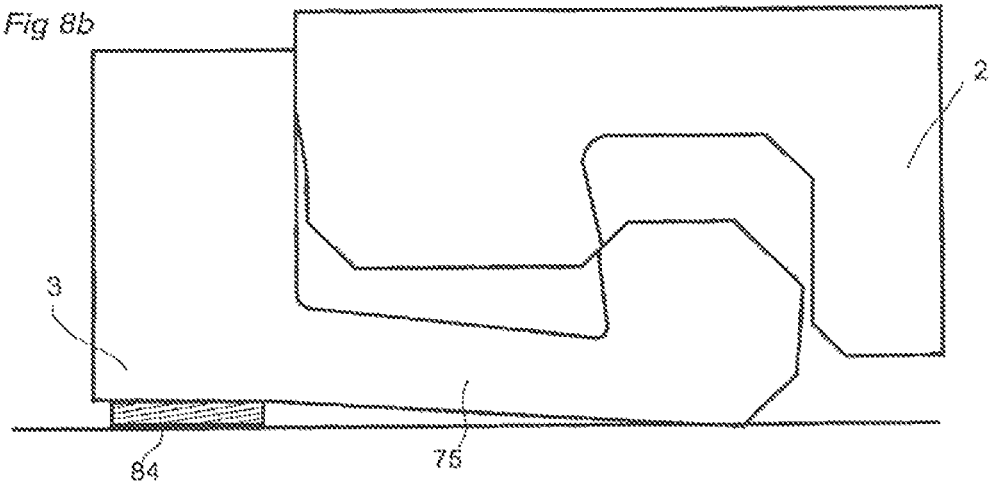
Figure 8C:
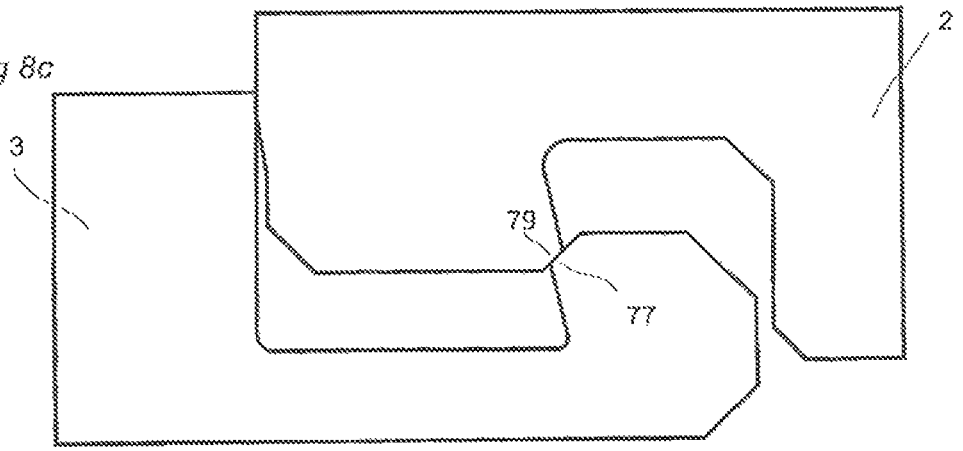

The number and area of the contact and locking surfaces should generally be minimized to ease connection of the floorboards. A small play 45 between the top edges of the floorboards (see FIG. 7*b*, 45) makes them easier to install, but a tight (see. FIG. 7*a*) fit increases the vertical locking strength. To achieve a connection which is more resistant to moisture it is possible to have contact surfaces and a tight fit between the between the lower edges of the floorboards, which also increases the vertical and horizontal locking strength. However, the tight fit also makes it harder to connect the floorboards and a space (see FIG. 8*a-c*, 85) makes it easier. An even more moisture resistant connection is achieved if the space 72 above the upwardly protruding locking element is eliminated (see FIG. 7*c*).

The angle 12 between the locking surfaces and the upper surface of the floorboards are preferably more than 90° to obtain a vertical locking in the position where the locking surface cooperates.

The locking strips 71, 75 are integrally formed in the floorboard, and preferably the whole locking system is integrally formed in one piece with the resilient material of the floorboard. However, it is possible to add separate pieces to increase the locking strength, e.g. in the form of a tongue of stiffer material, of e.g. plastic or metal of e.g. aluminum, preferably for the vertical locking.

A downwardly bending across edge of the lower locking strip 75 (see FIG. 8*b*) further facilitates the positioning of the locking elements in the position where the locking surface cooperates. Bending of the lower strip is preferably achieved by positioning of a spacer 84 between the floorboard edge and the subfloor, and inside the lower locking strip such that the lower locking strip can bend freely. It is also possible to produce a lower locking strip whose lower part is removed to create a free space between the subfloor and lower the locking strip. However, that also reduces the bending strength of the locking strip, which is not desirable since a locking strip of resilient material, e.g. vinyl, has a relatively weak resilient strength. A reduced bending strength of the locking strip means a reduced locking strength of the locking system.

Figure 9A:
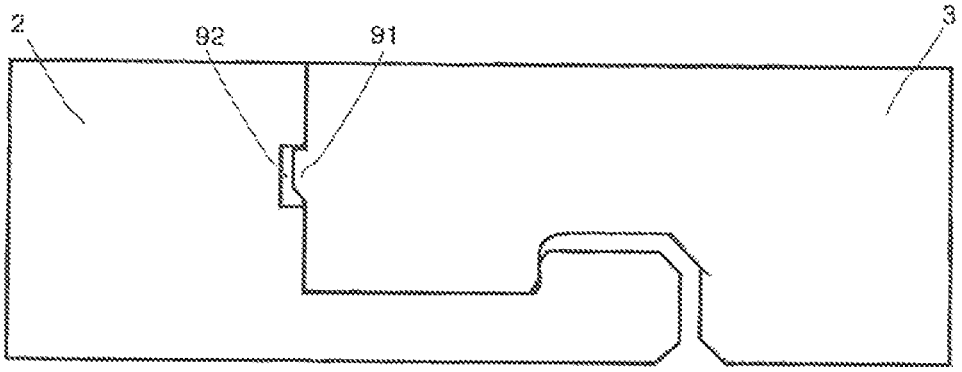
FIGS. 9*a*-9*b* show an embodiment of a locking system and an embodiment of the assembling tool.
Figure 9B:
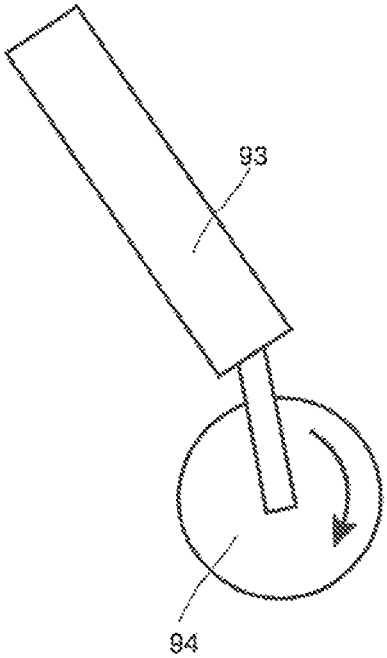

FIG. 9*a* shows an embodiment comprising a tongue 91 at the edge of a floorboard, cooperating with a tongue groove 92 at the edge of an adjacent floorboard, cooperating for vertical locking of the floorboards. The embodiment in FIG. 9*a* is provided with the tongue at the edge of the floorboard with the upper locking strip and the tongue groove at the edge of the floorboard with the lower locking strip. However it is also possible to provide the tongue at the edge of the floorboard with the lower locking strip and the tongue groove at the edge of the floorboard with the upper locking strip. These embodiments may be combined with the locking surface angle 12 that is more than 90°, as disclosed in FIGS. 6*a* to 8*c*, to obtain an increased vertical locking in the position where the locking surface cooperates.

The invention claimed is:

1. A set of resilient floorboards, each floorboard provided with a mechanical locking system for vertical and horizontal locking to an adjacent floorboard, the mechanical locking system comprising a first device at a first edge, and a second device at a second edge, wherein the floorboards each include a core made of a thermoplastic material, wherein the first device comprises a downwardly protruding locking element and the second device comprises an upwardly protruding locking element, wherein the downwardly protruding locking element is provided with an angled first locking surface configured to cooperate with an angled second locking surface of the upwardly protruding locking element of the adjacent floorboard for locking the first edge vertically and horizontally with the second edge of the adjacent floorboard, wherein the first edge and the first device are resiliently bendable with an axis of curvature that is perpendicular to the second edge of the second floorboard, the curvature being convex toward the bottom surface of the floorboards, wherein the first device further comprises a locking groove configured to form a tight fit with the upwardly protruding locking element, wherein the angled first locking surface is configured to contact the angled second locking surface of the upwardly protruding locking element, and wherein a surface of the locking groove opposite the angled first locking surface is configured to contact a surface of the upwardly protruding locking element opposite the angled second locking surface, wherein the first edge comprises a first top edge and the second edge comprise a second top edge, wherein a surface of the first top edge and a surface of the second top edge are vertical.

2. The set of resilient floorboards according to claim 1, wherein the lower locking strip of the second device is downwardly resiliently bendable.

3. The set of resilient floorboards according to claim 1, wherein an outermost side of the downwardly protruding locking element comprises at least an angled lower wall that angles inwards towards the upwardly protruding locking element of the adjacent floorboard.

4. The set of resilient floorboards according to claim 1, wherein the downwardly protruding locking element is provided with a first guiding surface configured to cooperate with the upwardly protruding locking element.

5. The set of resilient floorboards according to claim 4, wherein the upwardly protruding locking element is provided with a second guiding surface configured to cooperate with the first guiding surface.

6. The set of resilient floorboards according to claim 4, wherein the angle of the first guiding surface is more than about 30 degrees.

7. The set of resilient floorboards according to claim 4, wherein the angle of the first guiding surface is more than about 45 degrees.

8. The set of resilient floorboards according to claim 5, wherein the angle of the second guiding surface is more than about 30 degrees.

9. The set of resilient floorboards according to claim 5, wherein the angle of the second guiding surface is more than about 45 degrees.

10. The set of resilient floorboards according to claim 1, the angle between the first locking surface and the second locking surface and an upper surface of the floorboards is more than 90 degrees to obtain a vertical locking in a position where the first locking surface and the second locking surface cooperate.

11. The set of resilient floorboards according to claim 1, wherein the downwardly protruding locking element is provided with a guiding surface configured to cooperate with an upper edge of the adjacent floorboard.

12. The set of resilient floorboards according to claim 1, wherein the first edge is provided with a tongue and the second edge is provided with a groove for vertical locking of the floorboards.

13. The set of resilient floorboards according to claim 1, wherein the first edge is provided with a groove and the second edge is provided with a tongue for vertical locking of the floorboards.

14. The set of resilient floorboards according to claim 1, wherein the upper upwardly resiliently bendable locking strip and the lower locking strip are integrally formed in the floorboard.

15. The set of resilient floorboards according to claim 1, wherein the floorboards are comprised of resilient material and the mechanical locking system is integrally formed in one piece with the resilient material of each floorboard.

16. The set of resilient floorboards according to claim 1, wherein the core of each floorboard includes the first and second devices.

17. The set of resilient floorboards according to claim 1, wherein the angled first locking surface forms a first acute angle with a first adjacent surface of the protruding locking element, and the angled second locking surface forms a second acute angle with a second adjacent surface of the upwardly protruding locking element.

18. The set of resilient floorboards according to claim 1, wherein the first device further comprises an upper upwardly resiliently bendable locking strip configured to form a convex shape towards a bottom surface of the floorboard during locking.

19. The set of resilient floorboards according to claim 1, wherein the lower locking strip comprises an upper surface between the second top edge and the second locking surface, and wherein the downwardly protruding locking element and the upper surface of the lower locking strip are configured to be in contact when the floorboard and an adjacent floorboard are vertically and horizontally locked.

* * * * *